US010595587B2

(12) United States Patent
Cook et al.

(10) Patent No.: US 10,595,587 B2
(45) Date of Patent: Mar. 24, 2020

(54) ARTICLE OF FOOTWEAR WITH A SEGMENTED PLATE HAVING A HEEL REGION

(71) Applicant: NIKE, Inc., Beaverton, OR (US)

(72) Inventors: Christopher S. Cook, Portland, OR (US); David J. Roulo, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 168 days.

(21) Appl. No.: 14/754,925

(22) Filed: Jun. 30, 2015

(65) Prior Publication Data

US 2016/0000180 A1 Jan. 7, 2016

Related U.S. Application Data

(60) Provisional application No. 62/020,565, filed on Jul. 3, 2014.

(51) Int. Cl.
*A43B 13/16* (2006.01)
*A43B 5/06* (2006.01)
(Continued)

(52) U.S. Cl.
CPC ..... *A43B 13/16* (2013.01); *A43B 5/02* (2013.01); *A43B 5/06* (2013.01); *A43B 13/122* (2013.01);
(Continued)

(58) Field of Classification Search
CPC .. A43B 13/16; A43B 5/02; A43B 5/06; A43B 13/122; A43B 13/141; A43B 13/26;
(Continued)

(56) References Cited

U.S. PATENT DOCUMENTS 1,392,704 A * 10/1921 Pierce ..... A43C 15/167 152/210
2,082,537 A * 6/1937 Butler ..... A43B 5/06 36/107

(Continued)

FOREIGN PATENT DOCUMENTS

JP S5691702 A 7/1981

OTHER PUBLICATIONS

Taiwan Intellectual Property Office, Official Letter and Search Report for TW Application No. 104121527, dated Nov. 29, 2016.

(Continued)

*Primary Examiner* — Anna K Kinsaul
*Assistant Examiner* — F Griffin Hall
(74) *Attorney, Agent, or Firm* — Honigman LLP; Matthew H. Szalach; Jonathan P. O'Brien

(57) ABSTRACT

An article of footwear includes a sole having a first plate and a second plate. The first plate includes a first edge, and the second plate includes a second edge, where the first edge faces the second edge. The first edge has a first contour corresponding to a second contour of the second edge. The first plate includes a heel region, where the heel region includes a first heel region and a second heel region. A notch region separates the first heel region and the second heel region, where the notch region extends from an outer edge of the heel region toward the midfoot portion of the article of footwear. The first plate and the second plate may improve an amount of energy return while running by increasing a rigidity of the sole.

19 Claims, 25 Drawing Sheets

(51) Int. Cl.

| | |
|---|---|
| ***A43C 15/16*** | (2006.01) |
| ***A43B 13/14*** | (2006.01) |
| ***A43B 5/02*** | (2006.01) |
| ***A43B 13/12*** | (2006.01) |
| ***A43B 13/26*** | (2006.01) |

(52) U.S. Cl.
CPC ..... *A43B 13/141* (2013.01); *A43B 13/26* (2013.01); *A43C 15/16* (2013.01)

(58) Field of Classification Search
CPC ..... A43B 13/026; A43B 13/10; A43B 13/41; A43B 13/42; A43B 13/12; A43B 3/0047; A43B 13/14; A43B 13/181; A43B 13/183; A43B 13/185; A43C 15/16; A43C 15/168; A43C 15/161
USPC ..... 36/67 A, 103, 126, 127, 128, 129, 134, 36/107, 102
See application file for complete search history.

(56) References Cited

U.S. PATENT DOCUMENTS

| | | | | | |
|---|---|---|---|---|---|
| 2,118,107 | A * | 5/1938 | Riddell | A43C 15/161 | 36/107 |
| 3,010,229 | A * | 11/1961 | Snitzer | A43C 15/165 | 36/127 |
| 3,204,347 | A * | 9/1965 | Snow | A43B 5/06 | 36/107 |
| 3,461,576 | A * | 8/1969 | Hubbard | A43B 15/00 | 36/32 R |
| 4,085,526 | A * | 4/1978 | Hemmer | A43B 13/26 | 36/59 R |
| 4,507,879 | A * | 4/1985 | Dassler | A43B 5/02 | 36/102 |
| 4,546,559 | A * | 10/1985 | Dassler | A43B 5/06 | 36/114 |
| 4,962,596 | A * | 10/1990 | Dufour | A43B 5/001 | 36/127 |
| 5,384,973 | A * | 1/1995 | Lyden | A43B 13/12 | 36/102 |
| 5,473,827 | A * | 12/1995 | Barre | A43B 5/02 | 36/128 |
| 5,786,057 | A | 7/1998 | Lyden et al. | | |
| 5,979,083 | A | 11/1999 | Robinson et al. | | |
| 6,145,221 | A * | 11/2000 | Hockerson | A43B 5/02 | 36/126 |
| 6,857,205 | B1 * | 2/2005 | Fusco | A43B 5/00 | 36/102 |
| 6,954,998 | B1 | 10/2005 | Lussier | | |
| 2002/0178619 | A1 * | 12/2002 | Schaudt | A43B 5/02 | 36/128 |
| 2003/0069807 | A1 | 4/2003 | Lyden | | |
| 2003/0131503 | A1 | 7/2003 | Erickson et al. | | |
| 2005/0016029 | A1 * | 1/2005 | Auger | A43B 1/0072 | 36/134 |
| 2006/0064905 | A1 | 3/2006 | Hudson et al. | | |
| 2006/0168847 | A1 * | 8/2006 | Myers | A43B 7/08 | 36/3 B |
| 2008/0098624 | A1 * | 5/2008 | Goldman | A43C 15/16 | 36/126 |
| 2009/0013561 | A1 * | 1/2009 | Robinson, Jr. | A43B 5/001 | 36/127 |
| 2009/0249648 | A1 * | 10/2009 | Brown | A43B 5/001 | 36/91 |
| 2011/0047830 | A1 * | 3/2011 | Francello | A43B 13/203 | 36/134 |
| 2011/0192056 | A1 * | 8/2011 | Geser | A43B 13/26 | 36/114 |
| 2012/0233886 | A1 * | 9/2012 | Madore | A43B 13/141 | 36/103 |
| 2012/0279091 | A1 * | 11/2012 | Baucom | A43B 3/0042 | 36/67 A |
| 2013/0067765 | A1 * | 3/2013 | Auger | A43B 5/02 | 36/31 |
| 2013/0326908 | A1 * | 12/2013 | Grott | A43B 5/001 | 36/62 |
| 2015/0282557 | A1 * | 10/2015 | Kirk | A43B 13/141 | 36/31 |

OTHER PUBLICATIONS

International Searching Authority, International Search Report and Written Opinion for Application No. PCT/US2015/039059, dated Oct. 7, 2015.

China National Intellectual Property Administration, Notification of the First Office Action for CN Application No. 201580044416.6, dated Sep. 30, 2018.

European Patent Office, Communication pursuant to Article 94(3) EPC for EP Application No. 15739434.7, dated Oct. 8, 2019.

China National Intellectual Property Administration, The Second Office Action for CN Application No. 201580044416.6, dated Jun. 14, 2019.

* cited by examiner

ARTICLE OF FOOTWEAR WITH A SEGMENTED PLATE HAVING A HEEL REGION

CROSS REFERENCE TO RELATED APPLICATION

This application Claims the benefit of U.S. Provisional Patent Application Ser. No. 62/020,565, filed Jul. 3, 2014, the entire contents of which are hereby incorporated by reference.

FIELD

The present disclosure relates generally to an article of footwear for track events and methods of making an article of footwear.

BACKGROUND

This section provides background information related to the present disclosure which is not necessarily prior art.

Articles of footwear intended for use during a particular sporting event are known. Such articles typically include features that are designed to provide an athlete with a particular advantage during use. For example, conventional articles of footwear specifically designed for use during track and field events typically include cleats or spikes that provide the athlete with the ability to positively grip a track or other running surface.

While conventional articles of footwear designed for track and field events generally include cleats or spikes that provide the athlete with the ability to positively grip a running surface, the soles of such articles of footwear are typically formed from a relatively soft material. For example, the material of an outsole of such articles of footwear is typically formed from a foam material that allows the footwear to flex and bend during running and sprinting events. Accordingly, such conventional articles of footwear are incapable of storing energy created during flexing of the article and, as such, provide little in the way of energy return to the athlete during use.

BRIEF DESCRIPTION OF THE DRAWINGS

The configurations can be better understood with reference to the following drawings and description. The components in the figures are not necessarily to scale, emphasis instead being placed on illustrating the principles of the configurations. Moreover, in the figures, like reference numerals designate corresponding parts throughout the different views.

DESCRIPTION

Figure 1:
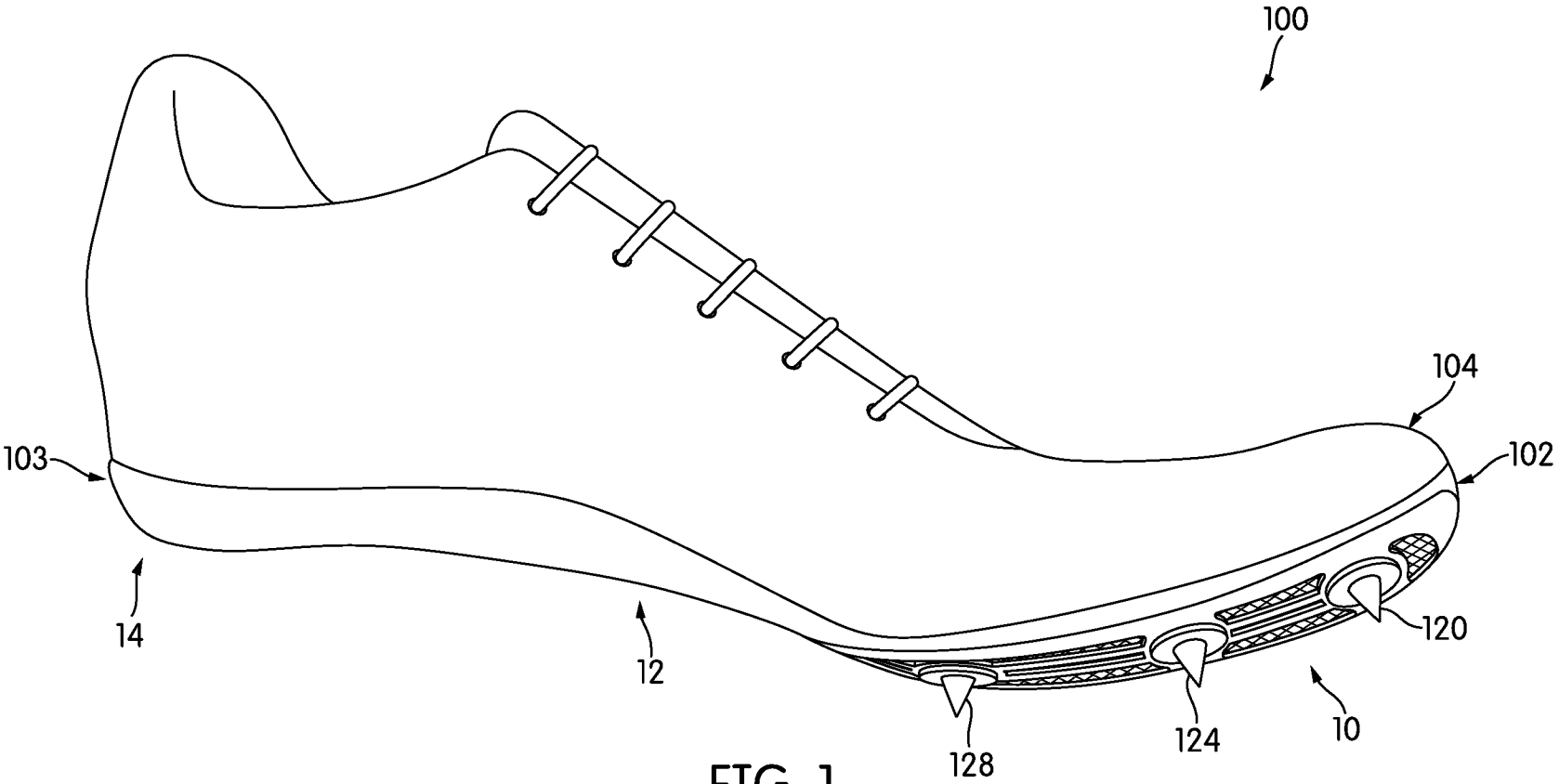
FIG. 1 is a side view of an exemplary configuration of an article of footwear having a sole plate.

Example configurations will now be described more fully with reference to the accompanying drawings. Example configurations are provided so that this disclosure will be thorough, and will fully convey the scope of the disclosure to those of ordinary skill in the art. Specific details are set forth such as examples of specific components, devices, and methods, to provide a thorough understanding of configurations of the present disclosure. It will be apparent to those of ordinary skill in the art that specific details need not be employed, that example configurations may be embodied in many different forms, and that the specific details and the example configurations should not be construed to limit the scope of the disclosure.

The terminology used herein is for the purpose of describing particular exemplary configurations only and is not intended to be limiting. As used herein, the singular articles "a," "an," and "the" may be intended to include the plural forms as well, unless the context clearly indicates otherwise. The terms "comprises," "comprising," "including," and "having," are inclusive and therefore specify the presence of features, steps, operations, elements, and/or components, but do not preclude the presence or addition of one or more other features, steps, operations, elements, components, and/or groups thereof. The method steps, processes, and operations described herein are not to be construed as necessarily requiring their performance in the particular order discussed or illustrated, unless specifically identified as an order of performance. Additional or alternative steps may be employed.

When an element or layer is referred to as being "on," "engaged to," "connected to," "attached to," or "coupled to" another element or layer, it may be directly on, engaged, connected, attached, or coupled to the other element or layer, or intervening elements or layers may be present. In contrast, when an element is referred to as being "directly on," "directly engaged to," "directly connected to," "directly attached to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

The terms first, second, third, etc. may be used herein to describe various elements, components, regions, layers and/or sections. These elements, components, regions, layers and/or sections should not be limited by these terms. These terms may be only used to distinguish one element, component, region, layer or section from another region, layer or section. Terms such as "first," "second," and other numerical terms do not imply a sequence or order unless clearly indicated by the context. Thus, a first element, component, region, layer or section discussed below could be termed a second element, component, region, layer or section without departing from the teachings of the example configurations.

The following detailed description discusses an exemplary configuration in the form of an article of footwear for use during track and field events, but it should be noted that the present concept may be associated with any article of footwear, including, but not limited to, articles of footwear intended for use during baseball, rugby, and football as well as virtually any athletic event. The articles of footwear shown in the figures may be intended to be used with a left foot. However, it should be understood that the following discussion may apply to mirror images of the articles of footwear that may be intended to be used with a right foot.

An article of footwear is disclosed. The article of footwear may generally include a sole comprising a first plate and a second plate. The first plate and second plate may have contours to allow flexing in the lateral direction of the article of footwear. For example, the first plate may include a heel region having a first heel region and a second heel region. Moreover, a notch region may separate the first heel region and the second heel region. In some instances, the notch region allows the article of footwear to be more flexible along a lateral axis than along a longitudinal axis. As such, the article of footwear may store an even greater amount of energy along the longitudinal axis while maintaining an amount of flexibility along the lateral axis of the heel region. The article of footwear may facilitate improved energy return while running, for example.

The article of footwear includes a sole comprising a first plate and a second plate. The first plate extends along a longitudinal axis from a midfoot portion of the article of footwear to a heel portion of the article of footwear. The second plate extends from a forefoot portion of the article of footwear to the midfoot portion of the article of footwear. The first plate includes a first edge, and the second plate includes a second edge, wherein the first edge faces the second edge. The first edge has a first contour corresponding to a second contour of the second edge. The first plate includes a heel region, wherein the heel region includes a first heel region and a second heel region. The article of footwear further includes a notch region separating the first heel region and the second heel region, wherein the notch region extends from an outer edge of the heel region toward the midfoot portion of the article of footwear. The first plate and second plate may improve an amount of energy return while running by increasing a rigidity of the sole.

The article of footwear including the first plate and the second plate may also be configured so that the first plate includes a forefoot region, a transition region, and a midfoot region. Moreover, the transition region may extend between the forefoot region and the midfoot region. Further, the midfoot region extends from an exposed lateral edge of the sole to an exposed medial edge of the sole.

The article of footwear including the first plate and the second plate may also be configured so that the first plate includes a forefoot region, a transition region, and a midfoot region. Moreover, the transition region may extend between the forefoot region and the midfoot region. Further, the midfoot region extends from an exposed lateral edge of the sole to an exposed medial edge of the sole. Additionally, the longitudinal axis may be centrally located between the medial side and the lateral side.

The article of footwear including the first plate and the second plate may also be configured so that the first plate includes a forefoot region, a transition region, and a midfoot region. Moreover, the transition region may extend between the forefoot region and the midfoot region. Further, the midfoot region extends from an exposed lateral edge of the sole to an exposed medial edge of the sole. Additionally, the longitudinal axis may be centrally located between the medial side and the lateral side. Moreover, the first plate may include a first rigid member and/or the first rigid member may extend from the forefoot portion to the heel portion. Further, the second plate may include a second rigid member and/or the second rigid member may extend from the forefoot portion to the midfoot portion.

The article of footwear including the first plate and the second plate may also be configured so that the first plate includes a forefoot region, a transition region, and a midfoot region. Moreover, the transition region may extend between the forefoot region and the midfoot region. Further, the midfoot region extends from an exposed lateral edge of the sole to an exposed medial edge of the sole. Additionally, the longitudinal axis may be centrally located between the medial side and the lateral side. Moreover, the first plate may include a first rigid member and/or the first rigid member may extend from the forefoot portion to the heel portion. Further, the second plate may include a second rigid member and/or the second rigid member may extend from the forefoot portion to the midfoot portion. Additionally, the first rigid member may extend along the first contour and/or the first rigid member may maintain a substantially constant first distance from the first edge. Moreover, the second rigid member may extend along the second contour and/or the second rigid member may maintain a substantially constant second distance from the second edge.

The article of footwear including the first plate and the second plate may also be configured so that the first plate includes a forefoot region, a transition region, and a midfoot region. Moreover, the transition region may extend between the forefoot region and the midfoot region. Further, the midfoot region extends from an exposed lateral edge of the sole to an exposed medial edge of the sole. Additionally, the longitudinal axis may be centrally located between the medial side and the lateral side. Moreover, the first plate may include a first rigid member and/or the first rigid member may extend from the forefoot portion to the heel portion. Further, the second plate may include a second rigid member and/or the second rigid member may extend from the forefoot portion to the midfoot portion. Additionally, the first rigid member may extend along the first contour and/or the first rigid member may maintain a substantially constant first distance from the first edge. Moreover, the second rigid member may extend along the second contour and/or the second rigid member may maintain a substantially constant second distance from the second edge. Further, the second plate may include a central region and a lateral region. Additionally, the central region may include the second edge and/or the central region may also include a third edge. Moreover, the second edge may be opposite the third edge. Further, the third edge may have a third contour corresponding to the first contour of the first edge. Additionally, the lateral region may include a fourth edge, the fourth edge facing the third edge. Moreover, the fourth edge may have a fourth contour corresponding to the second contour of the second edge.

The article of footwear including the first plate and the second plate may also be configured so that the first plate includes a forefoot region, a transition region, and a midfoot region. Moreover, the transition region may extend between the forefoot region and the midfoot region. Further, the midfoot region extends from an exposed lateral edge of the sole to an exposed medial edge of the sole. Additionally, the longitudinal axis may be centrally located between the medial side and the lateral side. Moreover, the first plate may include a first rigid member and/or the first rigid member may extend from the forefoot portion to the heel portion. Further, the second plate may include a second rigid member and/or the second rigid member may extend from the forefoot portion to the midfoot portion. Additionally, the first rigid member may extend along the first contour and/or the first rigid member may maintain a substantially constant first distance from the first edge. Moreover, the second rigid member may extend along the second contour and/or the second rigid member may maintain a substantially constant second distance from the second edge. Further, the second plate may include a central region and a lateral region. Additionally, the central region may include the second edge and/or the central region may also include a third edge. Moreover, the second edge may be opposite the third edge. Further, the third edge may have a third contour corresponding to the first contour of the first edge. Additionally, the lateral region may include a fourth edge, the fourth edge facing the third edge. Moreover, the fourth edge may have a fourth contour corresponding to the second contour of the second edge. Further, the second plate may include a third rigid member, the third rigid member may extend from the forefoot portion to the midfoot portion. Additionally, the third rigid member may extend along the fourth contour, the third rigid member maintaining a substantially constant third distance from the fourth edge. Moreover, the second rigid member may extend along the third contour and/or the second rigid member may maintain a substantially constant fourth distance from the third edge.

The article of footwear including the first plate and the second plate may also be configured so that the first plate includes a forefoot region, a transition region, and a midfoot region. Moreover, the transition region may extend between the forefoot region and the midfoot region. Further, the midfoot region extends from an exposed lateral edge of the sole to an exposed medial edge of the sole. Additionally, the longitudinal axis may be centrally located between the medial side and the lateral side. Moreover, the first plate may include a first rigid member and/or the first rigid member may extend from the forefoot portion to the heel portion. Further, the second plate may include a second rigid member and/or the second rigid member may extend from the forefoot portion to the midfoot portion. Additionally, the first rigid member may extend along the first contour and/or the first rigid member may maintain a substantially constant first distance from the first edge. Moreover, the second rigid member may extend along the second contour and/or the second rigid member may maintain a substantially constant second distance from the second edge. Further, the second plate may include a central region and a lateral region. Additionally, the central region may include the second edge and/or the central region may also include a third edge. Moreover, the second edge may be opposite the third edge. Further, the third edge may have a third contour corresponding to the first contour of the first edge. Additionally, the lateral region may include a fourth edge, the fourth edge facing the third edge. Moreover, the fourth edge may have a fourth contour corresponding to the second contour of the second edge. Further, the second plate may include a third rigid member, the third rigid member may extend from the forefoot portion to the midfoot portion. Additionally, the third rigid member may extend along the fourth contour, the third rigid member maintaining a substantially constant third distance from the fourth edge. Moreover, the second rigid member may extend along the third contour and/or the second rigid member may maintain a substantially constant fourth distance from the third edge. Further, the first plate may include a first set of cleats, the first set of cleats being disposed under the first rigid member. Additionally, the second plate may include a second set of cleats and/or the second set of cleats may be disposed under the second rigid member and the third rigid member.

The article of footwear including the first plate and the second plate may also be configured so that the first plate includes a forefoot region, a transition region, and a midfoot region. Moreover, the transition region may extend between the forefoot region and the midfoot region. Further, the midfoot region extends from an exposed lateral edge of the sole to an exposed medial edge of the sole. Additionally, the longitudinal axis may be centrally located between the medial side and the lateral side. Moreover, the first plate may include a first rigid member and/or the first rigid member may extend from the forefoot portion to the heel portion. Further, the second plate may include a second rigid member and/or the second rigid member may extend from the forefoot portion to the midfoot portion. Additionally, the first rigid member may extend along the first contour and/or the first rigid member may maintain a substantially constant first distance from the first edge. Moreover, the second rigid member may extend along the second contour and/or the second rigid member may maintain a substantially constant second distance from the second edge. Further, the second plate may include a central region and a lateral region. Additionally, the central region may include the second edge and/or the central region may also include a third edge. Moreover, the second edge may be opposite to the third edge. Further, the third edge may have a third contour corresponding to the first contour of the first edge. Additionally, the lateral region may include a fourth edge, the fourth edge facing the third edge. Moreover, the fourth edge may have a fourth contour corresponding to the second contour of the second edge. Further, the second plate may include a third rigid member, the third rigid member may extend from the forefoot portion to the midfoot portion. Additionally, the third rigid member may extend along the fourth contour, the third rigid member maintaining a substantially constant third distance from the fourth edge. Moreover, the second rigid member may extend along the third contour and/or the second rigid member may maintain a substantially constant fourth distance from the third edge. Further, the first plate may include a first set of cleats, the first set of cleats being disposed under the first rigid member. Additionally, the second plate may include a second set of cleats and/or the second set of cleats may be disposed under the second rigid member and the third rigid member. Further, the first rigid member may be attached to the first set of cleats by an elastomer. Additionally, the second rigid member and the third rigid member may be attached to the second set of cleats by the elastomer.

The article of footwear including the first plate and the second plate may also be configured so that the first plate includes a forefoot region, a transition region, and a midfoot region. Moreover, the transition region may extend between the forefoot region and the midfoot region. Further, the midfoot region extends from an exposed lateral edge of the sole to an exposed medial edge of the sole. Additionally, the longitudinal axis may be centrally located between the medial side and the lateral side. Moreover, the first plate may include a first rigid member and/or the first rigid member may extend from the forefoot portion to the heel portion. Further, the second plate may include a second rigid member and/or the second rigid member may extend from the forefoot portion to the midfoot portion. Additionally, the first rigid member may extend along the first contour and/or the first rigid member may maintain a substantially constant first distance from the first edge. Moreover, the second rigid member may extend along the second contour and/or the second rigid member may maintain a substantially constant second distance from the second edge. Further, the second plate may include a central region and a lateral region. Additionally, the central region may include the second edge and/or the central region may also include a third edge. Moreover, the second edge may be opposite the third edge. Further, the third edge may have a third contour corresponding to the first contour of the first edge. Additionally, the lateral region may include a fourth edge, the fourth edge facing the third edge. Moreover, the fourth edge may have a fourth contour corresponding to the second contour of the second edge. Further, the second plate may include a third rigid member, the third rigid member may extend from the forefoot portion to the midfoot portion. Additionally, the third rigid member may extend along the fourth contour, the third rigid member maintaining a substantially constant third distance from the fourth edge. Moreover, the second rigid member may extend along the third contour and/or the second rigid member may maintain a substantially constant fourth distance from the third edge. Further, the first plate may include a first set of cleats, the first set of cleats being disposed under the first rigid member. Additionally, the second plate may include a second set of cleats and/or the second set of cleats may be disposed under the second rigid member and the third rigid member. Further, the first rigid member may be attached to the first set of cleats by an elastomer. Additionally, the second rigid member and the third rigid member may be attached to the second set of cleats by the elastomer. Further, the heel region may be formed of the elastomer. Additionally, the heel region may be attached to the first rigid member.

The article of footwear including the first plate and the second plate may also be configured so that the first plate includes a forefoot region, a transition region, and a midfoot region. Moreover, the transition region may extend between the forefoot region and the midfoot region. Further, the midfoot region extends from an exposed lateral edge of the sole to an exposed medial edge of the sole. Additionally, the longitudinal axis may be centrally located between the medial side and the lateral side. Moreover, the first plate may include a first rigid member and/or the first rigid member may extend from the forefoot portion to the heel portion. Further, the second plate may include a second rigid member and/or the second rigid member may extend from the forefoot portion to the midfoot portion. Additionally, the first rigid member may extend along the first contour and/or the first rigid member may maintain a substantially constant first distance from the first edge. Moreover, the second rigid member may extend along the second contour and/or the second rigid member may maintain a substantially constant second distance from the second edge. Further, the second plate may include a central region and a lateral region. Additionally, the central region may include the second edge and/or the central region may also include a third edge. Moreover, the second edge may be opposite the third edge. Further, the third edge may have a third contour corresponding to the first contour of the first edge. Additionally, the lateral region may include a fourth edge, the fourth edge facing the third edge. Moreover, the fourth edge may have a fourth contour corresponding to the second contour of the second edge. Further, the second plate may include a third rigid member, the third rigid member may extend from the forefoot portion to the midfoot portion. Additionally, the third rigid member may extend along the fourth contour, the third rigid member maintaining a substantially constant third distance from the fourth edge. Moreover, the second rigid member may extend along the third contour and/or the second rigid member may maintain a substantially constant fourth distance from the third edge. Further, the first plate may include a first set of cleats, the first set of cleats being disposed under the first rigid member. Additionally, the second plate may include a second set of cleats and/or the second set of cleats may be disposed under the second rigid member and the third rigid member. Further, the first rigid member may be attached to the first set of cleats by an elastomer. Additionally, the second rigid member and the third rigid member may be attached to the second set of cleats by the elastomer. Further, the heel region may be formed of the elastomer. Additionally, the heel region may be attached to the first rigid member. Further, the first plate may include a rib, the rib extending from an outer surface of the first rigid member. Additionally, the rib may be formed of the elastomer.

The article of footwear including the first plate and the second plate may also be configured so that the first plate includes a forefoot region, a transition region, and a midfoot region. Moreover, the transition region may extend between the forefoot region and the midfoot region. Further, the midfoot region extends from an exposed lateral edge of the sole to an exposed medial edge of the sole. Additionally, the longitudinal axis may be centrally located between the medial side and the lateral side. Moreover, the first plate may include a first rigid member and/or the first rigid member may extend from the forefoot portion to the heel portion. Further, the second plate may include a second rigid member and/or the second rigid member may extend from the forefoot portion to the midfoot portion. Additionally, the first rigid member may extend along the first contour and/or the first rigid member may maintain a substantially constant first distance from the first edge. Moreover, the second rigid member may extend along the second contour and/or the second rigid member may maintain a substantially constant second distance from the second edge. Further, the second plate may include a central region and a lateral region. Additionally, the central region may include the second edge and/or the central region may also include a third edge. Moreover, the second edge may be opposite the third edge. Further, the third edge may have a third contour corresponding to the first contour of the first edge. Additionally, the lateral region may include a fourth edge, the fourth edge facing the third edge. Moreover, the fourth edge may have a fourth contour corresponding to the second contour of the second edge. Further, the second plate may include a third rigid member, the third rigid member extending from the forefoot portion to the midfoot portion. Additionally, the third rigid member may extend along the fourth contour, the third rigid member maintaining a substantially constant third distance from the fourth edge. Moreover, the second rigid member may extend along the third contour and/or the second rigid member may maintain a substantially constant fourth distance from the third edge. Further, the first plate may include a first set of cleats, the first set of cleats being disposed under the first rigid member. Additionally, the second plate may include a second set of cleats and/or the second set of cleats may be disposed under the second rigid member and the third rigid member. Further, the first rigid member may be attached to the first set of cleats by an elastomer. Additionally, the second rigid member and the third rigid member may be attached to the second set of cleats by the elastomer. Further, the heel region may be formed of the elastomer. Additionally, the heel region may be attached to the first rigid member. Further, the first plate may include a rib, the rib extending from an outer surface of the first rigid member. Additionally, the rib may be formed of the elastomer. Further, the rib may have a contour corresponding to a shape of the first plate.

The article of footwear including the first plate and the second plate may also be configured so that the first plate includes a forefoot region, a transition region, and a midfoot region. Moreover, the transition region may extend between the forefoot region and the midfoot region. Further, the midfoot region extends from an exposed lateral edge of the sole to an exposed medial edge of the sole. Additionally, the longitudinal axis may be centrally located between the medial side and the lateral side. Moreover, the first plate may include a first rigid member and/or the first rigid member may extend from the forefoot portion to the heel portion. Further, the second plate may include a second rigid member and/or the second rigid member may extend from the forefoot portion to the midfoot portion. Additionally, the first rigid member may extend along the first contour and/or the first rigid member may maintain a substantially constant first distance from the first edge. Moreover, the second rigid member may extend along the second contour and/or the second rigid member may maintain a substantially constant second distance from the second edge. Further, the second plate may include a central region and a lateral region. Additionally, the central region may include the second edge and/or the central region may also include a third edge. Moreover, the second edge may be opposite the third edge. Further, the third edge may have a third contour corresponding to the first contour of the first edge. Additionally, the lateral region may include a fourth edge, the fourth edge facing the third edge. Moreover, the fourth edge may have a fourth contour corresponding to the second contour of the second edge. Further, the second plate may include a third rigid member, the third rigid member extending from the forefoot portion to the midfoot portion. Additionally, the third rigid member may extend along the fourth contour, the third rigid member maintaining a substantially constant third distance from the fourth edge. Moreover, the second rigid member may extend along the third contour and/or the second rigid member may maintain a substantially constant fourth distance from the third edge. Further, the first plate may include a first set of cleats, the first set of cleats being disposed under the first rigid member. Additionally, the second plate may include a second set of cleats and/or the second set of cleats may be disposed under the second rigid member and the third rigid member. Further, the first rigid member may be attached to the first set of cleats by an elastomer. Additionally, the second rigid member and the third rigid member may be attached to the second set of cleats by the elastomer. Further, the heel region may be formed of the elastomer. Additionally, the heel region may be attached to the first rigid member. Further, the first plate may include a rib, the rib extending from an outer surface of the first rigid member. Additionally, the rib may be formed of the elastomer. Further, the rib may have a contour corresponding to a shape of the first plate. Additionally, the article of footwear may include a midsole comprising an upper surface and a lower surface, the lower surface of the midsole being attached to the sole. Moreover, the article of footwear may include an upper attached to the upper surface of the midsole. Further, the lower surface of the midsole may be exposed between the first edge and the second edge.

The article of footwear including the first plate and the second plate may also be configured so that the first plate includes a forefoot region, a transition region, and a midfoot region. Moreover, the transition region may extend between the forefoot region and the midfoot region. Further, the midfoot region extends from an exposed lateral edge of the sole to an exposed medial edge of the sole. Additionally, the longitudinal axis may be centrally located between the medial side and the lateral side. Moreover, the first plate may include a first rigid member and/or the first rigid member may extend from the forefoot portion to the heel portion. Further, the second plate may include a second rigid member and/or the second rigid member may extend from the forefoot portion to the midfoot portion. Additionally, the first rigid member may extend along the first contour and/or the first rigid member may maintain a substantially constant first distance from the first edge. Moreover, the second rigid member may extend along the second contour and/or the second rigid member may maintain a substantially constant second distance from the second edge. Further, the second plate may include a central region and a lateral region. Additionally, the central region may include the second edge and/or the central region may also include a third edge. Moreover, the second edge may be opposite the third edge. Further, the third edge may have a third contour corresponding to the first contour of the first edge. Additionally, the lateral region may include a fourth edge, the fourth edge facing the third edge. Moreover, the fourth edge may have a fourth contour corresponding to the second contour of the second edge. Further, the second plate may include a third rigid member, the third rigid member extending from the forefoot portion to the midfoot portion. Additionally, the third rigid member may extend along the fourth contour, the third rigid member maintaining a substantially constant third distance from the fourth edge. Moreover, the second rigid member may extend along the third contour and/or the second rigid member may maintain a substantially constant fourth distance from the third edge. Further, the first plate may include a first set of cleats, the first set of cleats being disposed under the first rigid member. Additionally, the second plate may include a second set of cleats and/or the second set of cleats may be disposed under the second rigid member and the third rigid member. Further, the first rigid member may be attached to the first set of cleats by an elastomer. Additionally, the second rigid member and the third rigid member may be attached to the second set of cleats by the elastomer. Further, the heel region may be formed of the elastomer. Additionally, the heel region may be attached to the first rigid member. Further, the first plate may include a rib, the rib extending from an outer surface of the first rigid member. Additionally, the rib may be formed of the elastomer. Further, the rib may have a contour corresponding to a shape of the first plate. Additionally, the article of footwear may include a midsole comprising an upper surface and a lower surface, the lower surface of the midsole being attached to the sole. Moreover, the article of footwear may include an upper attached to the upper surface of the midsole. Further, the lower surface of the midsole may be exposed between the first edge and the second edge. Additionally, the first rigid member may be carbon fiber.

The article of footwear including the first plate and the second plate may also be configured so that the first plate includes a forefoot region, a transition region, and a midfoot region. Moreover, the transition region may extend between the forefoot region and the midfoot region. Further, the midfoot region extends from an exposed lateral edge of the sole to an exposed medial edge of the sole. Additionally, the longitudinal axis may be centrally located between the medial side and the lateral side. Moreover, the first plate may include a first rigid member and/or the first rigid member may extend from the forefoot portion to the heel portion. Further, the second plate may include a second rigid member and/or the second rigid member may extend from the forefoot portion to the midfoot portion. Additionally, the first rigid member may extend along the first contour and/or the first rigid member may maintain a substantially constant first distance from the first edge. Moreover, the second rigid member may extend along the second contour and/or the second rigid member may maintain a substantially constant second distance from the second edge. Further, the second plate may include a central region and a lateral region. Additionally, the central region may include the second edge and/or the central region may also include a third edge. Moreover, the second edge may be opposite the third edge. Further, the third edge may have a third contour corresponding to the first contour of the first edge. Additionally, the lateral region may include a fourth edge, the fourth edge facing the third edge. Moreover, the fourth edge may have a fourth contour corresponding to the second contour of the second edge. Further, the second plate may include a third rigid member, the third rigid member extending from the forefoot portion to the midfoot portion. Additionally, the third rigid member may extend along the fourth contour, the third rigid member maintaining a substantially constant third distance from the fourth edge. Moreover, the second rigid member may extend along the third contour and/or the second rigid member may maintain a substantially constant fourth distance from the third edge. Further, the first plate may include a first set of cleats, the first set of cleats being disposed under the first rigid member. Additionally, the second plate may include a second set of cleats and/or the second set of cleats may be disposed under the second rigid member and the third rigid member. Further, the first rigid member may be attached to the first set of cleats by an elastomer. Additionally, the second rigid member and the third rigid member may be attached to the second set of cleats by the elastomer. Further, the heel region may be formed of the elastomer. Additionally, the heel region may be attached to the first rigid member. Further, the first plate may include a rib, the rib extending from an outer surface of the first rigid member. Additionally, the rib may be formed of the elastomer. Further, the rib may have a contour corresponding to a shape of the first plate. Additionally, the article of footwear may include a midsole comprising an upper surface and a lower surface, the lower surface of the midsole being attached to the sole. Moreover, the article of footwear may include an upper attached to the upper surface of the midsole. Further, the lower surface of the midsole may be exposed between the first edge and the second edge. Additionally, the first rigid member may be carbon fiber. Moreover, the first plate and the second plate may be attached to an upper of the article of footwear.

A method of manufacturing an article of footwear is disclosed. The method includes providing a sole comprising a first plate and a second plate. The first plate is spaced from the second plate. The first plate extends from a forefoot portion of the article of footwear to a heel portion of the article of footwear. The second plate extends from the forefoot portion of the article of footwear to a midfoot portion of the article of footwear. The first plate includes a first edge and the second plate includes a second edge. The first edge faces the second edge. The first edge has a first contour corresponding to a second contour of the second edge. The first plate includes a heel region. The heel region includes a first heel region and a second heel region. A notch region separates the first heel region and the second heel region. The notch region extends from an outer edge of the heel region toward the midfoot portion of the article of footwear. The method further including combining the sole with an upper to form an article of footwear.

Other systems, methods, features and advantages of the invention will be, or will become, apparent to one of ordinary skill in the art upon examination of the following figures and detailed description. It is intended that all such additional systems, methods, features and advantages be included within this description and this summary, be within the scope of the invention, and be protected by the following claims.

For example, and in one configuration, an article of footwear is provided and includes an upper and a midsole attached to the upper and including a first surface opposing the upper and a second surface formed on an opposite side of the midsole than the first surface. The article of footwear additionally includes a first sole plate attached to the midsole and including a first rigidity higher than a rigidity of the midsole and a second sole plate attached to the midsole and including a second rigidity higher than a rigidity of the midsole. The second sole plate opposes and is spaced apart from the first sole plate by a channel extending along a length of the first sole plate and the second sole plate.

In one configuration, the midsole includes a groove formed into the midsole in an area between the first sole plate and the second sole plate. In this configuration, the groove may be formed along the channel and/or may include the same shape as and may be positioned within the channel.

At least one first cleat may be attached to the first sole plate and at least one second cleat may be attached to the second sole plate. Additionally, the first sole plate may include a first rigid member and the second sole plate may include a second rigid member, whereby the first rigid member and the second rigid member are attached to the midsole via an elastomer. The at least one first cleat may be attached to the first sole plate and the at least one second cleat may be attached to the second sole plate, whereby the at least one first cleat extends from the elastomer and includes a flange disposed between the first rigid member and the elastomer and the at least one second cleat extends from the elastomer and includes a flange disposed between the second rigid member and the elastomer.

In one configuration, the second sole plate includes a third rigid member at least partially spaced apart from the second rigid member. A channel may at least partially separate the second rigid member from the third rigid member. Finally, the elastomer may extend over a portion of the first rigid member and may extend over a portion of the second rigid member.

In another configuration, an article of footwear is provided and includes an upper and a midsole attached to the upper and including a first surface opposing the upper and a second surface formed on an opposite side of the midsole than the first surface. A first sole plate is attached to the midsole and includes a first rigid member attached to the midsole by an elastomer, whereby the first rigid member has a higher rigidity than the midsole. A second sole plate is attached to the midsole and includes a second rigid member attached to the midsole by the elastomer, whereby the second rigid member has a higher rigidity than the midsole.

In one configuration, the first sole plate is spaced apart from the second sole plate by a channel. A groove may be formed into the midsole in an area between the first sole plate and the second sole plate and, further, may be formed along the channel. The groove may include the same shape as and may be positioned within the channel.

At least one first cleat may be attached to the first sole plate and at least one second cleat may be attached to the second sole plate. The at least one first cleat may extend from the elastomer and may include a flange disposed between the first rigid member and the elastomer and the at least one second cleat may extend from the elastomer and may include a flange disposed between the second rigid member and the elastomer.

In one configuration, the second sole plate includes a third rigid member at least partially spaced apart from the second rigid member. A channel may at least partially separate the second rigid member from the third rigid member. Finally, the elastomer may extend over a portion of the first rigid member and may extend over a portion of the second rigid member.

FIG. 1 illustrates an article of footwear 100, or simply article 100, including a sole plate 102 affixed to an upper 104. The upper 104 may be attached to the sole plate 102 by any known mechanism or method. For example, the upper 104 may be stitched to sole plate 102 and/or the upper 104 may be glued to sole plate 102. The upper 104 may be configured to receive a foot. The exemplary configuration shows a generic design for the upper 104. In some configurations, the upper 104 may include another type of design. For instance, the upper 104 may be a seamless warp knit tube of mesh.

In some configurations, the article 100 includes a midsole 103. As shown in FIG. 1, the midsole 103 may be disposed between the upper 104 and the sole plate 102. The midsole 103 may be formed of various materials and may include a first surface opposing the upper 104 and a second surface formed on an opposite side of the midsole 103 than the first surface to provide a surface for attachment of the sole plate 102 to the article 100. For example, the midsole 103 may be formed from a cushioning material such as an expanded rubber, foam rubber, polyurethane, and the like that is softer and, thus, more flexible than the sole plate 102. In other configurations, the midsole 103 is omitted (not shown).

The sole plate 102 and upper 104 may be made from materials known in the art for making articles of footwear. For example, the sole plate 102 may be made from elastomers, siloxanes, natural rubber, synthetic rubbers, aluminum, steel, natural leather, synthetic leather, plastics, and/or thermoplastics. In another example, the upper 104 may be made from nylon, natural leather, synthetic leather, natural rubber, and/or synthetic rubber.

A sole plate may be characterized as having various portions or regions associated with different portions or regions of a foot. The sole plate 102 may include a forefoot region disposed proximate to a wearer's forefoot. For example, as shown in FIG. 1, the sole plate 102 may include a forefoot portion 10. The sole plate 102 may include a heel region disposed proximate to a wearer's heel and opposite the forefoot region. For example, sole plate 102 may include a heel portion 14. The sole plate 102 may include a midfoot region disposed between the forefoot region and the heel region. For example, the sole plate 102 may include a midfoot portion 12.

Figure 2:
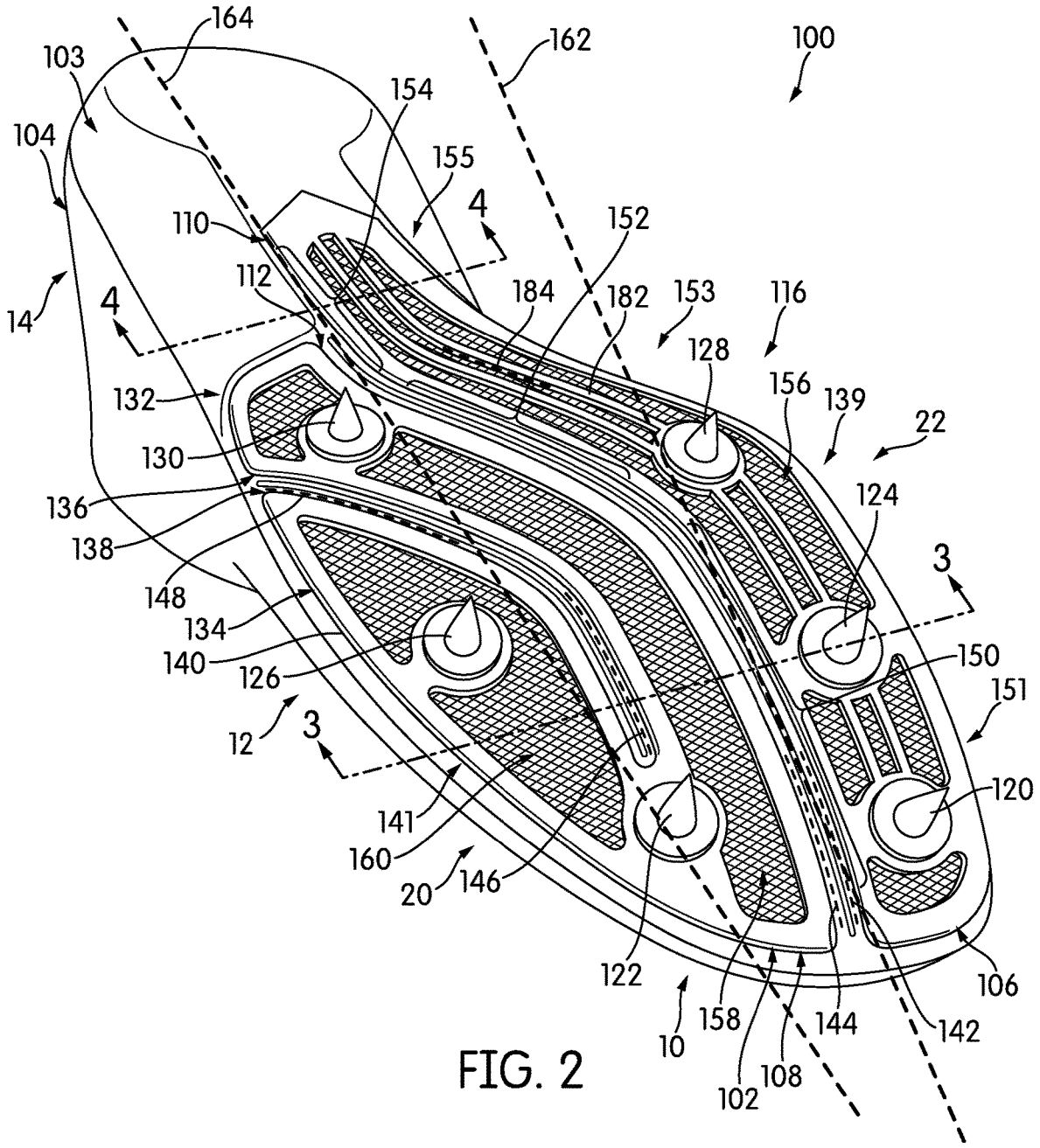
FIG. 2 is an isometric view of the sole plate of FIG. 1.

Referring now to FIG. 2, the sole plate may include a medial side and a lateral side opposite the medial side. For example, as shown, the sole plate 102 may include a medial side 22 and a lateral side 20. In one configuration, the sole plate 102 includes an exposed medial edge 139 on the medial side 22 and an exposed lateral edge 141 on the lateral side 20.

The bottom surface of the sole plate 102 may be configured to contact a playing surface. For example, the bottom surface 116 may be configured to contact grass, synthetic turf, dirt, or sand. The bottom surface 116 of the sole plate 102 may include provisions for increasing traction with such a playing surface. For example, as shown in FIG. 2, such provisions may include cleats or spikes. As shown, for example in FIG. 2, first cleat 120, a second cleat 122, a third cleat 124, a fourth cleat 126, a fifth cleat 128, and a sixth cleat 130 may be disposed on forefoot portion 10 of sole plate 102. Additional cleats (not shown) may be disposed on heel portion 14 of sole plate 102 and/or on midfoot portion 12 of sole plate 102.

In some configurations, the sole plate 102 may include cleats that extend from the bottom surface 116. For example, as shown in FIG. 2, sole plate 102 may include cleats integrally formed with sole plate 102 through molding. In another example, the sole plate 102 may be configured to receive cleats. In some configurations, the sole plate 102 may include cleat receiving members configured to receive removable cleat members. For example, the cleat receiving members may include threaded holes and the cleats may screw into the threaded holes. In some configurations, the cleat receiving members may be raised with respect to the sole plate. In other configurations, the cleat receiving members may be flush with the bottom surface 116 of the sole plate 102.

The cleats 120-130 may be made from materials known in the art for making articles of footwear. For example, the cleats 120-130 may be made from elastomers, siloxanes, natural rubber, synthetic rubbers, aluminum, steel, natural leather, synthetic leather, plastics, and/or thermoplastics. In some configurations, the cleats 120-130 may be made of the same materials. In other configurations, the cleats 120-130 may be made of various materials. For example, the first cleat 120 may be made of aluminum while the second cleat 122 is made of a thermoplastic material.

The cleats 120-130 may have any type of shape. In some configurations, the cleats 120-130 may all have the same shape. For example, in the exemplary configuration shown in FIGS. 1-2, first cleat 120 may have a similar or even identical shape to sixth cleat 130. In other configurations, at least one of the cleats 120-130 may have a different shape from another cleat. In some configurations, the cleats 120-130 may have a first set of identically shaped cleats and/or a second set of identically shaped cleats.

In some configurations, the cleats 120-130 may have the same height, width, and/or thickness as each other. In other configurations, the cleats 120-130 may have different heights, different widths, and/or different thicknesses from each other. In some configurations, a first set of cleats may have the same height, width, and/or thickness as each other, while a second set of cleats may have a different height, width, and/or thickness from the first set of cleats.

The cleats 120-130 may be arranged in any cleat pattern on the sole plate 102. For example, as shown in FIG. 2, the first cleat 120, the third cleat 124, and the fifth cleat 128 may be aligned with one another and may be disposed adjacent to the exposed medial edge 139. Similarly, in some configurations, the second cleat 122 and the sixth cleat 130 may be aligned with one another and may be disposed adjacent to the exposed lateral edge 141. Further, the fourth cleat 126 may also be substantially aligned with the second cleat 122 and the sixth cleat 130, and the fourth cleat 126 may be adjacent to the exposed lateral edge 141. While the configurations of FIGS. 1-20 are illustrated with the same cleat pattern (arrangement), it is understood that other cleat patterns may be used with the sole plate 102. The arrangement of the cleats 120-130 may enhance traction for a wearer during cutting, turning, stopping, accelerating, and backward movement.

The sole plate 102 may include components other than cleats that contact a playing surface and increase traction. In some configurations, the sole plate 102 may include traction elements (not shown) that are smaller than cleats or spikes. The traction elements on the sole plate may increase control for a wearer when maneuvering forward on a surface by engaging the surface. Additionally, traction elements may also increase the wearer's stability when making lateral movements by digging into a playing surface. In some configurations, the traction elements may be molded into the sole plate. In some configurations, the sole plate 102 may be configured to receive removable traction elements.

In one configuration, the sole plate 102 is segmented to provide flexibility in the lateral direction. As such, a user may have an improved feel of the playing surface during use of the article 100. For example, segmentation of the sole plate 102 may allow the article 100 to roll in response to an impact on the lateral side. Such a rolling function may be even further utilized in operations where a lateral impact onto a playing surface is common, for example, when a user is turning.

As shown in FIG. 2, the sole plate 102 may include a first sole plate 106 and a second sole plate 108 that are separate from one another and, as such, may be separately attached to the midsole 103 at the second surface of the midsole 103. As shown, the first plate 106 is spaced apart from the second plate 108. For example, as shown in FIG. 2, the first plate 106 is positioned on the midsole 103 such that no portion of the first plate 106 contacts the second plate 108. For example, the first plate 106 may be spaced apart from the second plate 108 by a channel extending along a length of each plate 106, 108. In one configuration, the channel has a constant width along a length of the channel such that a distance between the plates 106, 108 is constant along a length of each plate 106, 108. In some configurations, the first plate 106 is spaced apart from the second plate 108 such that the first plate 106 contacts the second plate 108 while in a forced position but not during a rest position. Such a forced position may occur, for example, during a turning operation. In other configurations, the first plate 106 is further spaced from the second plate 108 such that the first plate 106 does not contact the second plate 108 while in a forced position.

In some instances, flexibility in the lateral direction compared to the longitudinal direction is desired. In such cases, the first plate 106 may include a first edge 110 and the second plate 108 may include a second edge 112. In some configurations, the first edge 110 and second edge 112 are spaced from each other. Therefore, the first plate 106 and the second plate 108 may, at least partially, move relative to each other. As such, the first edge 110 and the second edge 112 may allow flexing in the lateral direction.

In some cases, even further flexibility in the lateral direction compared to the longitudinal direction is desired. In such cases, the second plate 108 may further include a central region 132 and a lateral region 134. For example, as shown in FIG. 2, the central region 132 includes the second edge 112 and further includes a third edge 136. Additionally, FIG. 2 shows that the lateral region 134 includes a fourth edge 138 and a fifth edge 140. As such, the first edge 110, the second edge 112, the third edge 136, and the fourth edge 138 allow the first plate 106, the central region 132, and the lateral region 134 to flex in the lateral direction.

It may be desirable to further improve flexibility in the lateral direction, for example, in order to improve a user's comfort during turns. In one example, the first plate 106 includes a forefoot region 151, a transition region 153, and a midfoot region 155. For instance, the transition region 153 may extend between the forefoot region 151 and the midfoot region 155. Additionally, the midfoot region 155 may extend from an exposed lateral edge 141 of the sole plate 102 (e.g., first edge 110) to an exposed medial edge 139 of the sole plate 102. Moreover, in some configurations, the forefoot region 151 may extend from the first edge 110 to the exposed medial edge 139 of the sole plate 102. Further, in one configuration, the transition region 153 may extend from the first edge 110 to the exposed medial edge 139 of the sole plate 102. In some configurations, the second plate 108 may extend from the exposed lateral edge 141 of the sole plate 102 to the second edge 112. Accordingly, the first plate 106 may have a shape to improve a user's comfort during turns by having an orientation angled between the medial axis 162 and the lateral axis 164. Further, the first plate 106 may extend farther along the article 100 in a direction from the forefoot portion 10 towards the heel portion 14 than the second plate 108.

In some cases the article 100 is provided with even further flexibility in the lateral direction compared to the longitudinal direction. For instance, in such configurations, the first edge 110 has a first contour 142. As shown in FIG. 2, the first edge 110 includes a forefoot segment 150, a transition segment 152, and a midfoot segment 154. As such, the first edge 110 has a first contour 142. In some configurations the second edge 112 has a second contour 144 that substantially corresponds to the first contour 142. Similarly, in some configurations the third edge 136 has a third contour 146 that substantially corresponds to the first contour 142. Moreover, in some configurations the fourth edge 138 has a fourth contour 148 that substantially corresponds to the first contour 142. As such, the first edge 110, the second edge 112, the third edge 136, and the fourth edge 138 allow the first plate 106, central region 132, and lateral region 134 to flex in the lateral direction. For example, the first contour 142 may have an orientation angled between the medial axis 162 and the lateral axis 164 to improve a user's comfort during turns.

As used herein a contour corresponds to another contour when shapes of the contours are similar. For example, the first contour 142 has a curve and/or or shape having a side extending along the medial axis 162, extending from the medial axis 162 at an angle, and extending along the lateral axis 164. Accordingly, in the example, the second contour 144 may correspond to the first contour 142 because the second contour 144 has a curve and/or shape equivalent to the first contour 142. In some configurations, contours having different lengths may correspond. For example, the first contour 142 includes a portion extending a long distance along the lateral axis 164 and the second contour 144 has a portion extending a short distance along an axis parallel to the medial axis 162.

In one configuration, the first plate extends from a forefoot portion of the article 100 to a heel portion of the article 100. For example, as shown in FIG. 2, the first plate 106 has a forefoot region 151 in the forefoot portion 10 that extends towards the heel portion 14. Moreover, the first plate 106 further includes a transition region 153 that extends through a midfoot portion 12. Further, the first plate 106 includes a midfoot region 155 that extends into the heel portion 14.

In one configuration, the second plate extends from a forefoot portion of the article 100 to a midfoot portion of the article 100. For example, as shown in FIG. 2, the second plate 108 has a central region 132 in the forefoot portion 10 that extends into the midfoot portion 12. Moreover, the second plate 108 further includes a lateral region 134 that extends in the forefoot portion 10. In some configurations, the lateral region 134 extends into the midfoot portion 12. As shown in FIG. 2, the central region 132 may be separated from the lateral region 134 by a channel to permit relative movement between the central region 132 and lateral region 134.

In some cases, the forefoot segment 150 extends along a medial axis extending in a substantially longitudinal direction along the medial side 22 of the article 100. For example, as shown in FIG. 2, the forefoot region 151 extends along medial axis 162.

In some cases, the midfoot segment 154 extends along a lateral axis extending in a substantially longitudinal direction along the lateral side 20 of the article 100. For example, as shown in FIG. 2, the midfoot region 155 extends along lateral axis 164.

In some configurations, the first cleat 120, the third cleat 124, and the fifth cleat 128 are a first set of cleats disposed under a first rigid member 156. For example, first cleat 120, the third cleat 124, and the fifth cleat 128 may be vertically separated from a lower surface of the first rigid member 156. Similarly, in some configurations, the second cleat 122, the fourth cleat 126, and the sixth cleat 130 are a second set of cleats disposed under a second rigid member 158 and a third rigid member 160. For example, second cleat 122, the fourth cleat 126, and the sixth cleat 130 may be vertically separated from a lower surface of the second rigid member 158 and the third rigid member 160.

Figure 3:
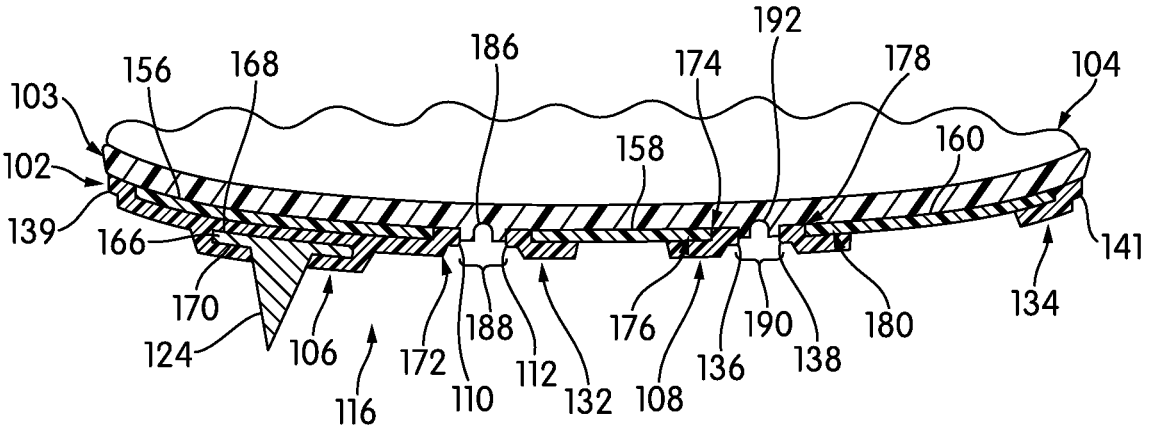
FIG. 3 is a first cross-sectional view of the sole plate of FIG. 1.

FIG. 3 illustrates a ground engagement surface of the first plate 106 and the second plate 108. In one configuration, an elastomer may be used to attach the first set of cleats to the first rigid member 156. For example, as shown, the third cleat 124 includes a flange 166 having an upper surface 168 and a lower surface 170. An elastomer 172 is formed between the first rigid member 156 and the upper surface 168 and the elastomer 172 is formed between the lower surface 170 and a bottom surface 116 of the first plate 106. The elastomer 172 may be formed of various materials. For example, the elastomer 172 may be a thermoplastic rubber, a thermoplastic elastomer (TPE) such as polyether block amide (PEBAX), and the like. In some configurations, the elastomer 172 may be transparent. In other configurations, the elastomer 172 is opaque. In some instances, the elastomer 172 has a portion combined with a coloring additive. For example, a transparent elastomer 172 may be combined with a blue color, resulting in the elastomer 172 having a blue appearance.

Similarly, in one configuration, the first cleat 120, the second cleat 122, the fourth cleat 126, the fifth cleat 128, and the sixth cleat 130 are attached in a similar fashion as the third cleat 124. For example, the fourth cleat 126 may be attached to the third rigid member 160 using elastomer 172. Moreover, in another example, the sixth cleat 130 may be attached to the second rigid member 158 using elastomer 172. In other configurations, cleats are attached differently. For example, the first cleat 120 may include a receiving member configured to receive a cleat member (not shown).

In one configuration, the elastomer 172 is attached to the first rigid member 156, the second rigid member 158, and the third rigid member 160 to form the sole plate 102. Further, the elastomer 172 may be used to attach the sole plate 102 to the midsole 103 by directly bonding to the second surface of the midsole 103. For example, as shown in FIG. 3, elastomer 172 is formed on side surfaces (e.g., side surface 174) of the second rigid member 158 and part of a lower surface 176 of the second rigid member 158. In another example as shown in FIG. 3, elastomer 172 is formed on side surfaces (e.g., side surface 178) of the third rigid member 160 and part of a lower surface 180 of the third rigid member 160.

In some instances, a portion 188 of the midsole 103 extending between the first edge 110 and the second edge 112 may be exposed. For instance, as shown in FIG. 3, the portion 188 is exposed to allow the first plate 106 and the second plate 108 to elastically move relative to each other. Moreover, the portion 188 may include a groove 186. In some configurations the groove 186 has a shape corresponding to a shape of the portion 188 of the midsole 103. For instance, a shape corresponding to the first contour 142 (as seen in FIG. 2).

In some instances, a portion 190 of the midsole 103 extending between the third edge 136 and the fourth edge 138 may be exposed. For instance, as shown in FIG. 3, the portion 190 is exposed to allow the central region 132 and the lateral region 134 to elastically move relative to each other. Moreover, the portion 190 may include a groove 192. In some configurations the groove 192 has a shape corresponding to a shape of the portion 190 of the midsole 103. For instance, a shape corresponding to the first contour 142 (as seen in FIG. 2).

Figure 4:
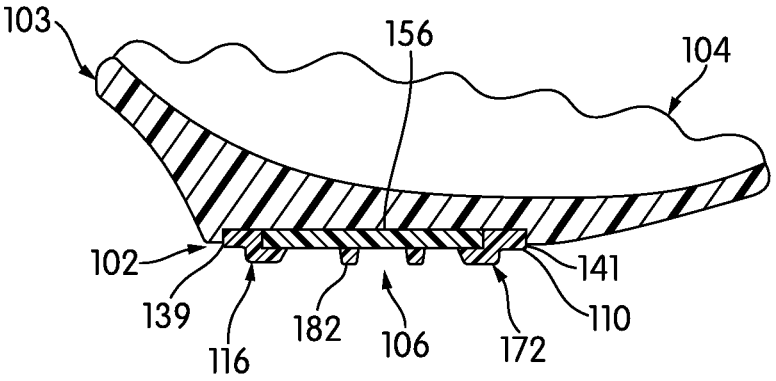
FIG. 4 is a second cross-sectional view of the sole plate of FIG. 1.

FIG. 4 illustrates a ground engagement surface of the first plate 106. In some instances, further energy storage in the sole plate 102 may be provided by the sole plate 102. For example, as shown in FIGS. 2 and 4, a rib 182 is formed on the bottom surface 116 of sole plate 102. In one configuration, the rib 182 extends from an outer surface of the first rigid member 156. In some configurations, the rib 182 may be formed of the elastomer. For example, as shown in FIG. 4, the rib 182 may be formed of elastomer 172. As such, the rib 182 may provide further rigidity to the first plate 106 as well as energy storage in the sole plate 102 while allowing lateral flexibility. In some configurations, sole plate 102 includes additional ribs that are similar to rib 182. For example, FIGS. 2 and 4 illustrate an additional rib corresponding to rib 182.

In some configurations, the rib has a rib contour to allow additional lateral flexibility. For example, as shown in FIG. 2, the rib 182 has a rib contour 184 corresponding to a shape of the first plate 106. As such, the rib 182 and the first plate 106 may allow the first plate 106 and rib 182 to flex in the lateral direction.

Figure 5:
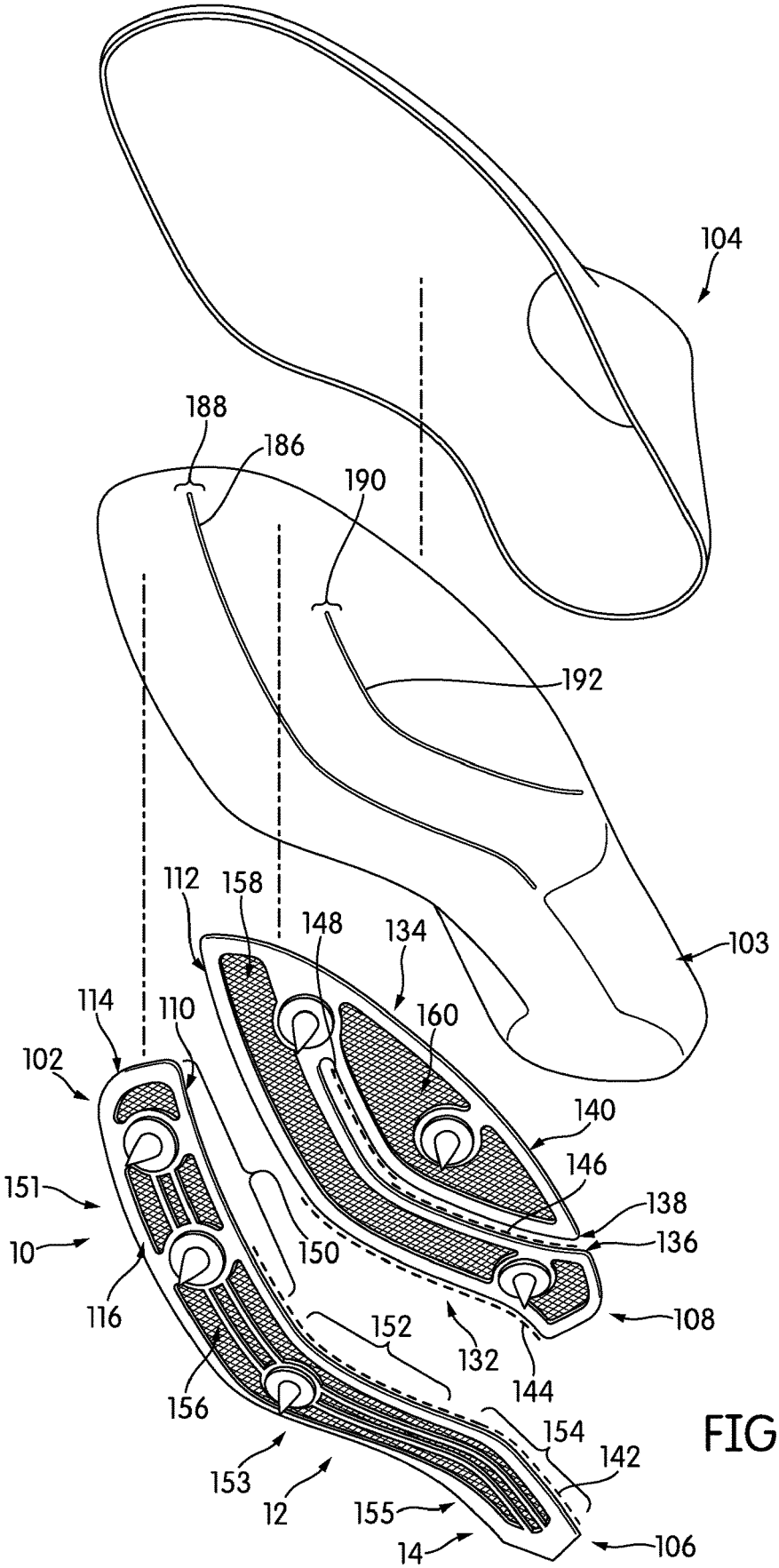
FIG. 5 is a first exploded view of the sole plate of FIG. 1.
Figure 6:
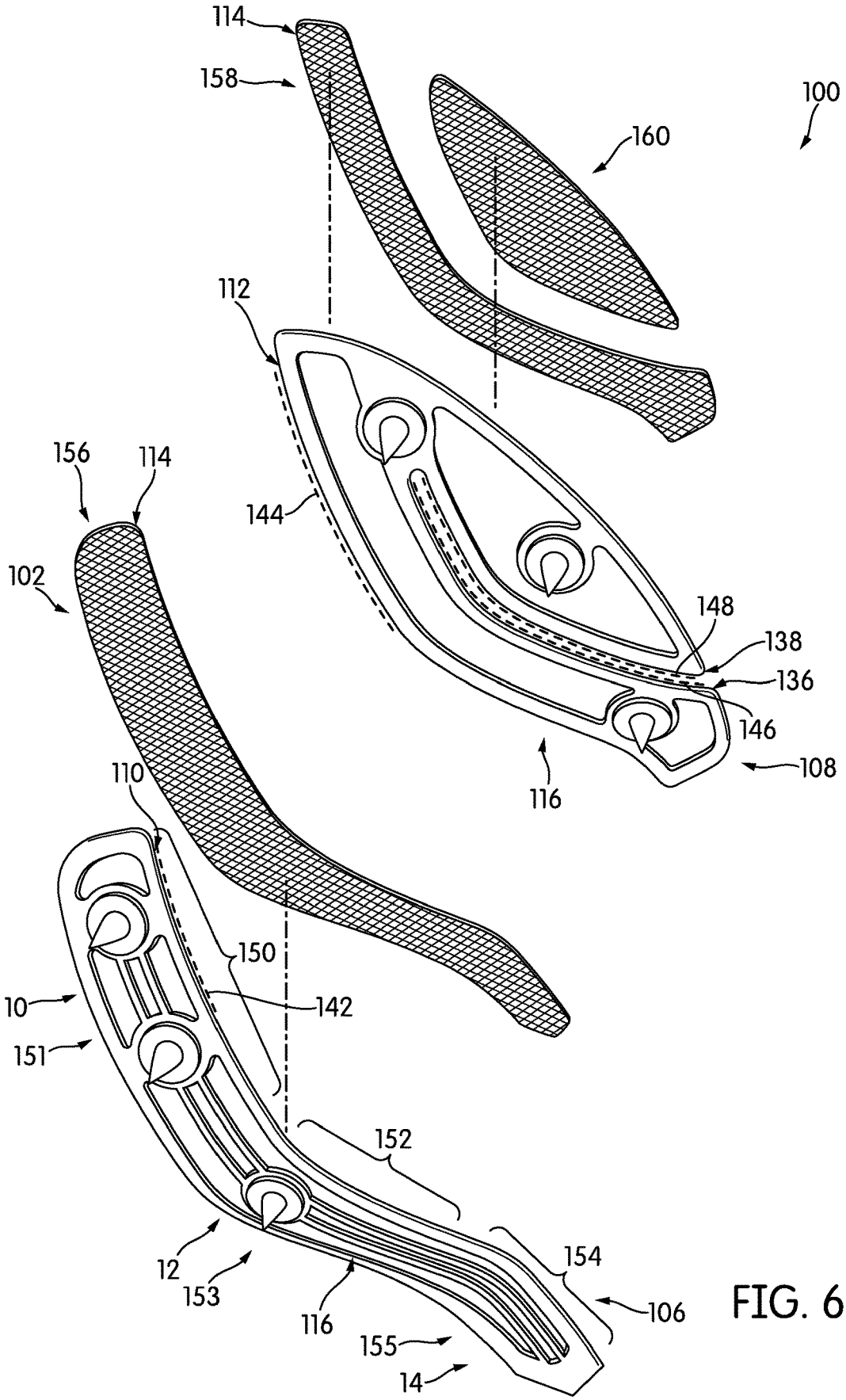
FIG. 6 is a second exploded view of the sole plate of FIG. 1.

FIGS. 5 and 6 illustrate exploded views of the article 100 as shown in FIGS. 1-4, according to exemplary configurations. As shown in FIG. 5, the sole plate 102 may include a top surface 114 and a bottom surface 116. The sole plate 102 may be configured to be attached to the upper 104. In some configurations, the sole plate 102 may be directly attached to the upper 104 or, alternately, may be attached to the upper 104 via the midsole 103, as described above and as shown in the drawings. Alternately, the sole plate 102 may be attached to the upper 104 via an insole of the article of footwear 100. In the above configurations, the top surface 114 may contact the midsole 103, the upper 104, or the insole directly.

As illustrated in FIGS. 5 and 6, some configurations may include the first rigid member 156, the second rigid member 158, and the third rigid member 160 that form at least a portion of the bottom surface of the sole plate 102. In some configurations, the first rigid member 156, the second rigid member 158, and/or the third rigid member 160 may be formed of a rigid material and are spaced apart and independent from one another. See, for example, FIG. 2, which shows the second rigid member 158 being separated from the third rigid member 160 by a channel (i.e. defined at contours 146, 148). For example, the first rigid member 156, the second rigid member 158, and/or the third rigid member 160 may be formed of carbon fiber and/or may include a rigidity that is higher than a rigidity of the midsole 103. In other examples, the first rigid member 156 is made of a rigid material different than the second rigid member 158 and/or the first rigid member 156 is made of a rigid material different than the third rigid member 160. Regardless of the particular materials used to form the first plate 106 and the second plate 108, the first plate 106 and the second plate 108 have a higher rigidity than the midsole 103.

In one configuration, the first rigid member 156, the second rigid member 158, and/or the third rigid member 160 may include one or more features of Auger et al. (U.S. Pat. No. 7,832,117), which is incorporated by reference herein in its entirety. In some configurations, one or more of the methods disclosed by Auger et al. may be used to construct the first rigid member 156, the second rigid member 158, and/or the third rigid member 160.

As previously noted, the rigid material may include carbon fiber, as well as other materials. In one configuration, the rigid material includes a woven fabric such as a carbon fiber, nylon fiber, cotton fiber, textile, elastomer fiber, animal fiber, and the like. In some configurations, the rigid material is a substance having a high Young's modulus. For example, a high Young's modulus may be greater than 100 gigapascal (GPa), greater than 150 GPa, greater than 180 GPa, greater than 200 GPa, etc. Examples of rigid material having a high Young's modulus may include, for instance, copper, brass, bronze, steel, silicon carbide, tungsten carbide, and a single-walled carbon nanotube, as well as other materials. The rigid material can comprise carbon fiber. The rigid material can consist essentially of carbon fiber.

In some cases, incorporating rigid material into a sole plate 102 restricts flexing of the article from a medial side to lateral side and from a lateral side to a medial side. Such flexing allows the article of footwear to have improved traction by providing additional contact with a playing surface. Moreover, such flexing allows for a more natural feel when contacting the playing surface. Accordingly, in some configurations, the article of footwear 100 may include at least one plate incorporating rigid material that is separated from another plate incorporating a rigid material. For example, as shown in FIGS. 5 and 6, the first plate 106 includes the first rigid member 156 and the second plate includes the second rigid member 158 and the third rigid member 160. As Illustrated in FIGS. 5 and 6, the first rigid member 156 may extend from the forefoot portion 10 to the heel portion 14. Similarly, the second rigid member 158 may extend from the forefoot portion 10 to the midfoot portion 12 and the third rigid member 160 may extend from the forefoot portion 10 to the midfoot portion 12. As shown in FIGS. 5 and 6, the second rigid member 158 and the third rigid member 160 are separate pieces of rigid material. In other configurations, the second rigid member 158 and the third rigid member 160 are monolithic (not shown).

In order to improve lateral flexing of the article of footwear 100, the rigid material may have a shape corresponding to a shape of the sole plate 102. For example, as shown in FIGS. 5 and 6, the first rigid member 156 extends along the first contour 142 and the first rigid member 156 maintains a substantially constant first distance from the first edge 110. Likewise, the second rigid member 158 extends along the second contour 144 and the second rigid member 158 maintains a substantially constant second distance from the second edge 112. Moreover, the third rigid member 160 extends along the fourth contour 148 and the third rigid member 160 maintains a substantially constant third distance from the fourth edge 138. Additionally, in some configurations, the second rigid member 158 extends along the third contour 146 and the second rigid member 158 maintains a substantially constant fourth distance from the third edge 136. In some configurations, the first distance, second distance, third distance, and fourth distance are identical. In other configurations, one or more of the first distance, second distance, third distance, and fourth distance are different.

In some configurations, "substantially constant" distance refers to a distance between two objects at a first point and a second point that are substantially equivalent. For example, as shown in FIGS. 5 and 6, the forefoot segment 150 is separated from the first rigid member 156 by a distance substantially equivalent to a distance between the transition segment 152 and the first rigid member 156. Similarly, the transition segment 152 is separated from the first rigid member 156 by a distance substantially equivalent to a distance between the midfoot segment 154 and the first rigid member 156. As used herein, substantially equivalent may refer to distances within various tolerance levels of one another, for example, less than one percent, less than five percent, less than ten percent, and less than twenty percent.

FIGS. 7-16 illustrate an article of footwear during operation. Specifically, FIGS. 7-16 illustrate various configurations of an article of footwear undergoing bending due to the features of sole plate 102 described above. For example, as shown in FIGS. 7-16, the article of footwear is the article 100.

Figure 7:
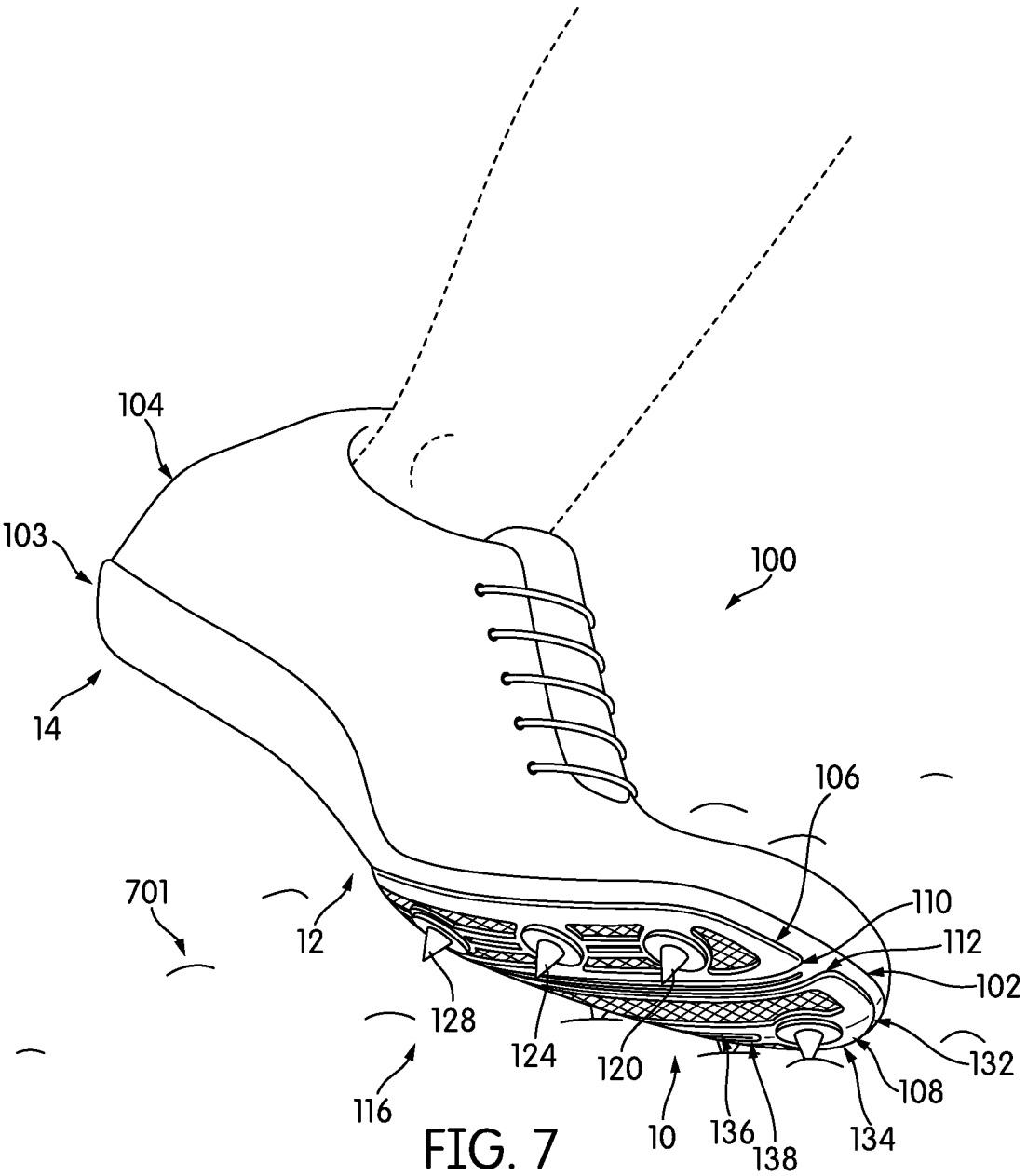
FIG. 7 is an isometric view of the sole plate of FIG. 1 during a first flexing of the sole plate.
Figure 8:
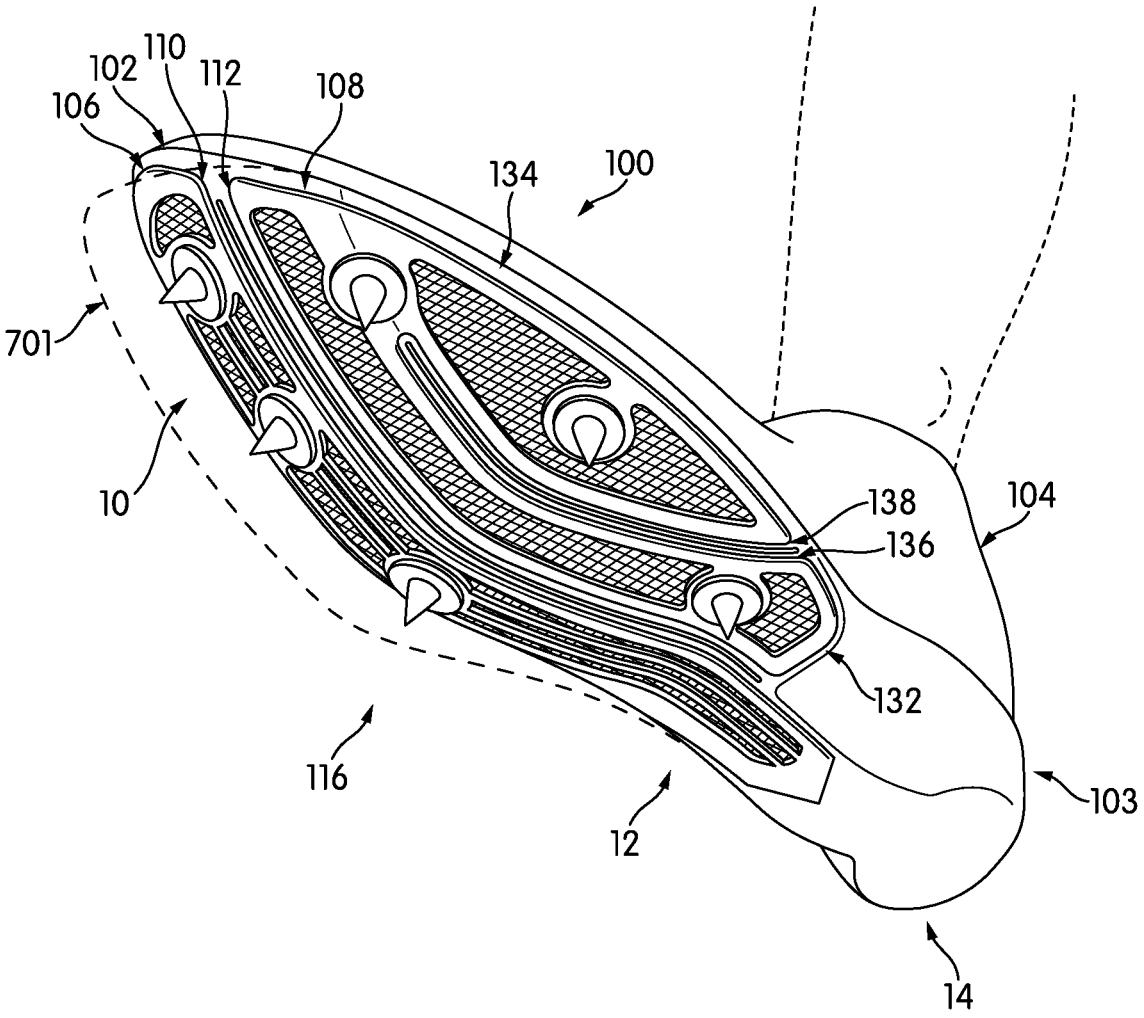
FIG. 8 is a bottom view of the sole plate of FIG. 1 during a first flexing of the sole plate.

As shown in FIGS. 7-8, a user contacts the bottom surface 116 of the sole plate 102 with a playing surface 701. As shown, the bottom surface 116 impacts the playing surface 701 in the forefoot portion 10 of the lateral region 134 of the second plate 108. As illustrated in FIGS. 7-8, due to the impact, the sole plate 102 may begin to flex along the third edge 136 of the central region 132 and the fourth edge 138 of the lateral region 134. This flexing may allow a more natural feel to a user, as the article 100 allows the user to feel a shape of the playing surface 701.

Figure 9:
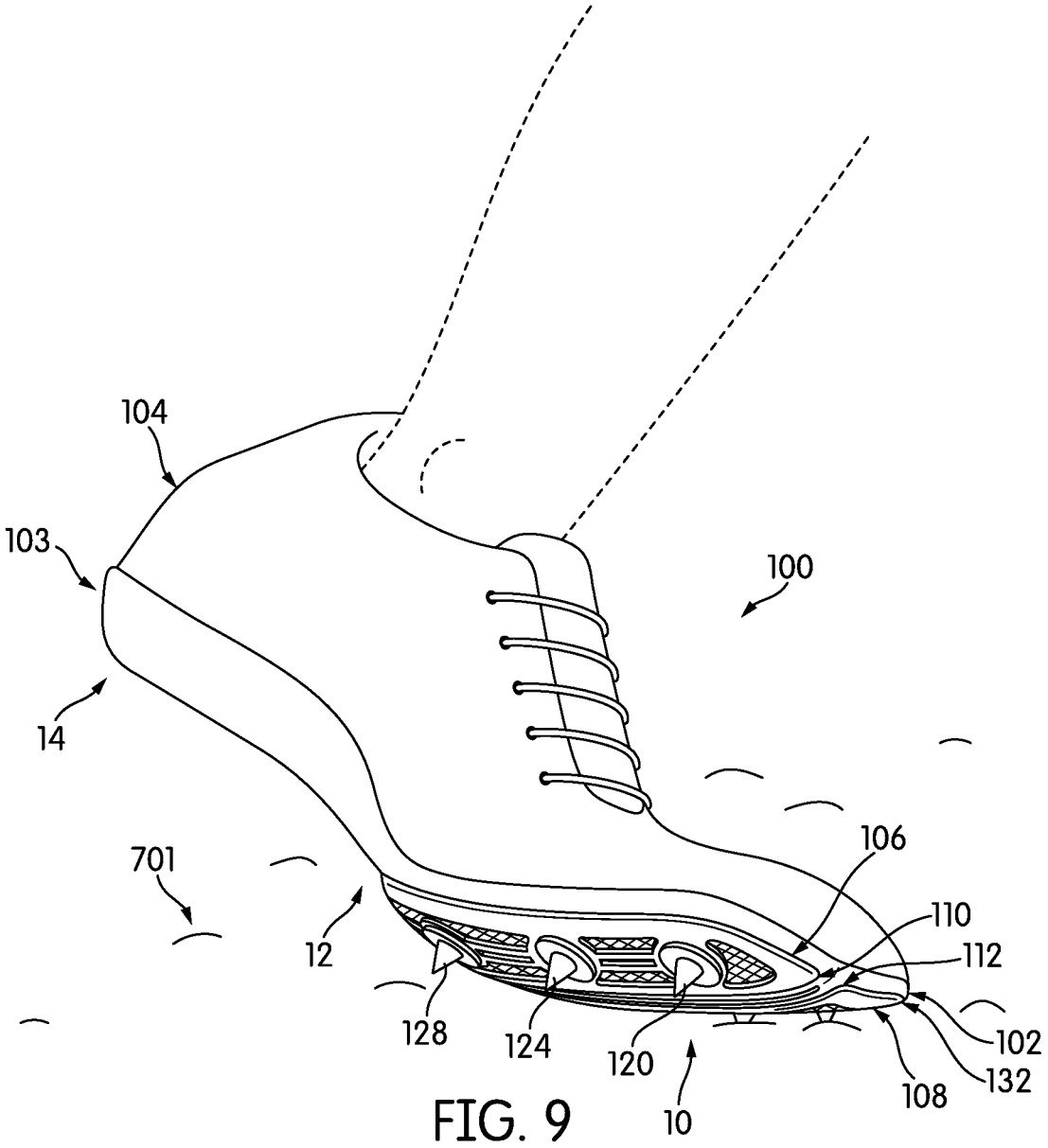
FIG. 9 is an isometric view of the sole plate of FIG. 1 during a second flexing of the sole plate.
Figure 10:
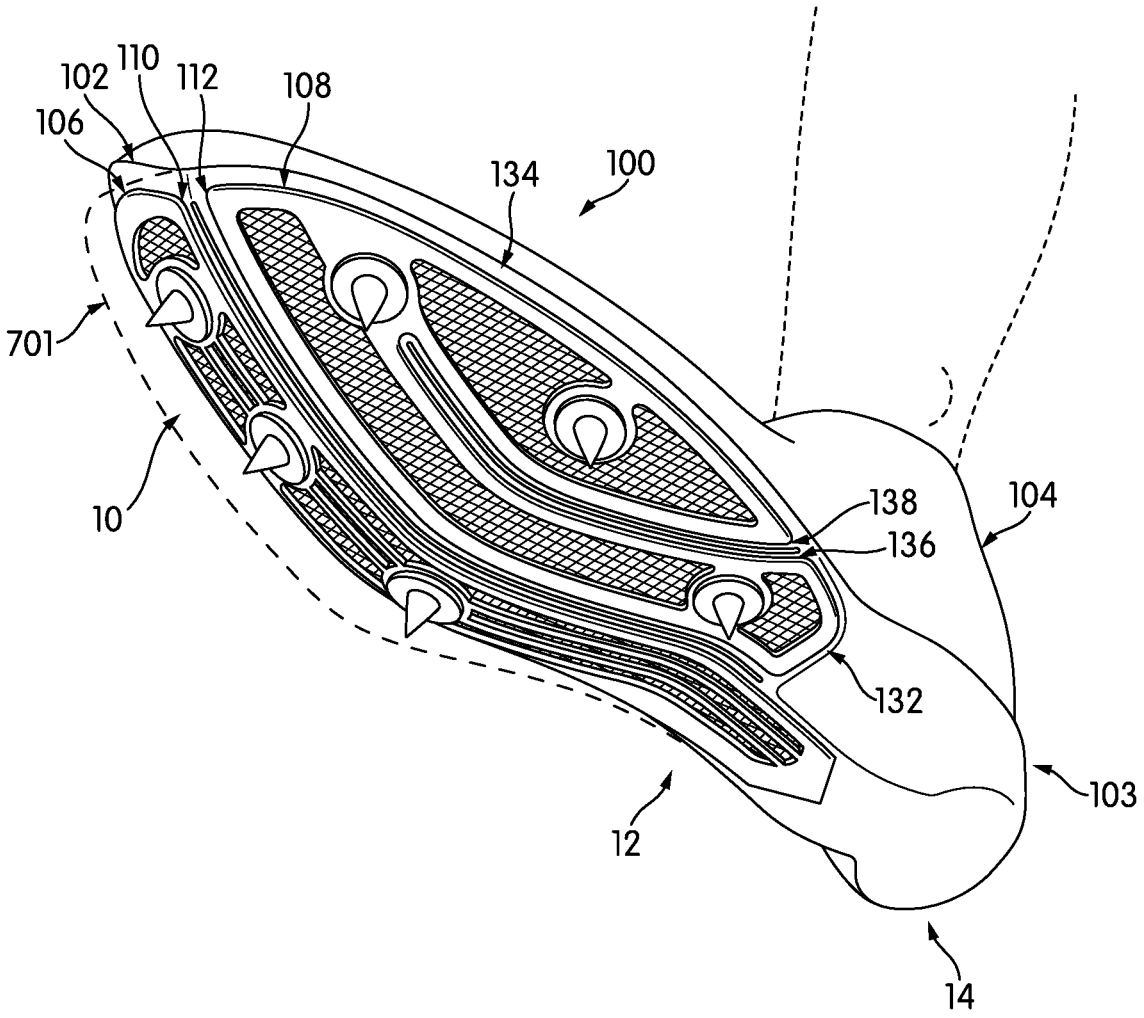
FIG. 10 is a bottom view of the sole plate of FIG. 1 during a second flexing of the sole plate.

As shown in FIGS. 9-10, the impact further causes the sole plate 102 to flex along the first edge 110 of the first plate 106 and the second edge 112 of the central region 132. This flexing allows an even further natural feel to a user, as the article 100 allows the user to feel a shape of the playing surface 701.

Figure 11:
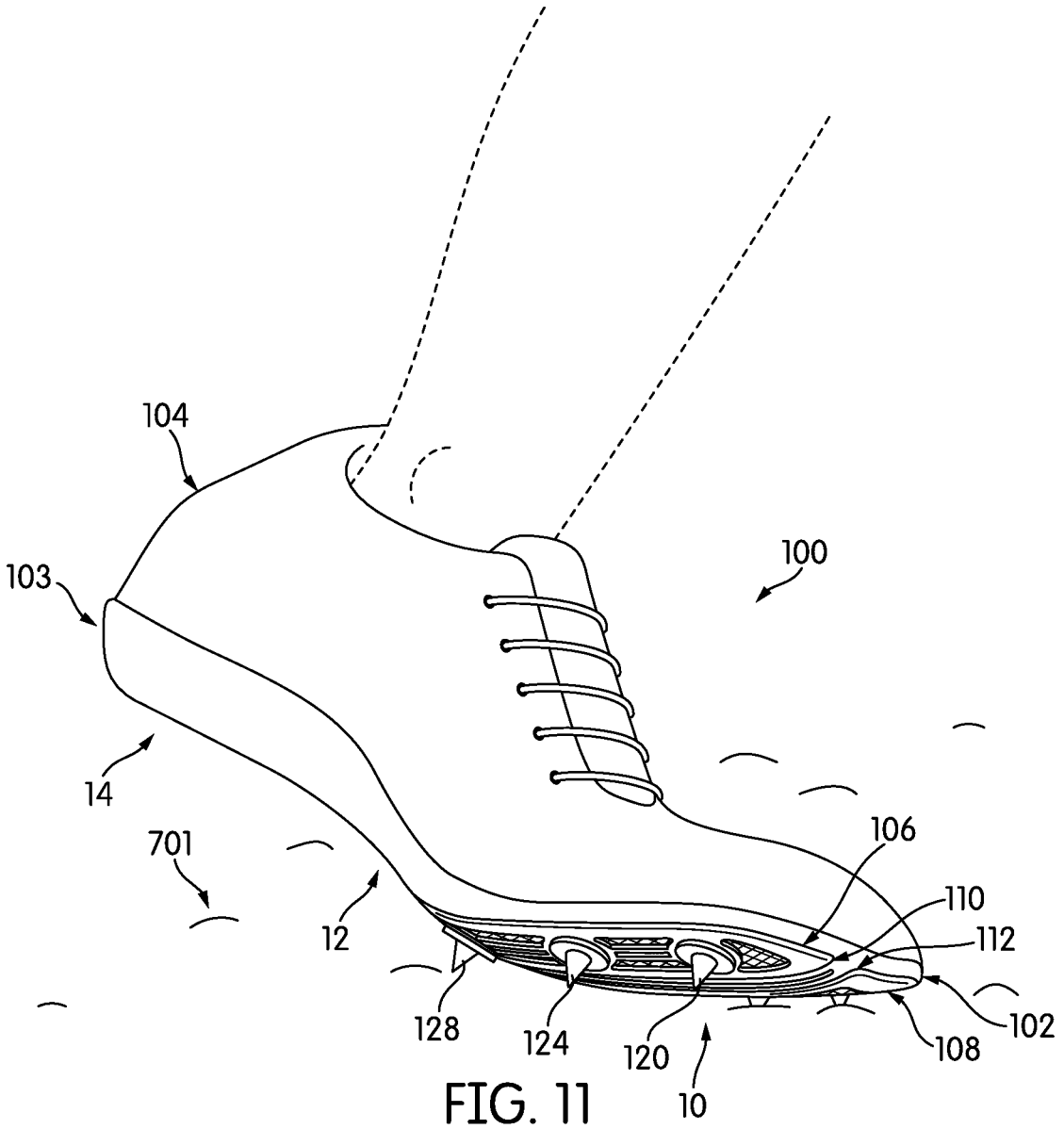
FIG. 11 is an isometric view of the sole plate of FIG. 1 after a second flexing of the sole plate.
Figure 12:
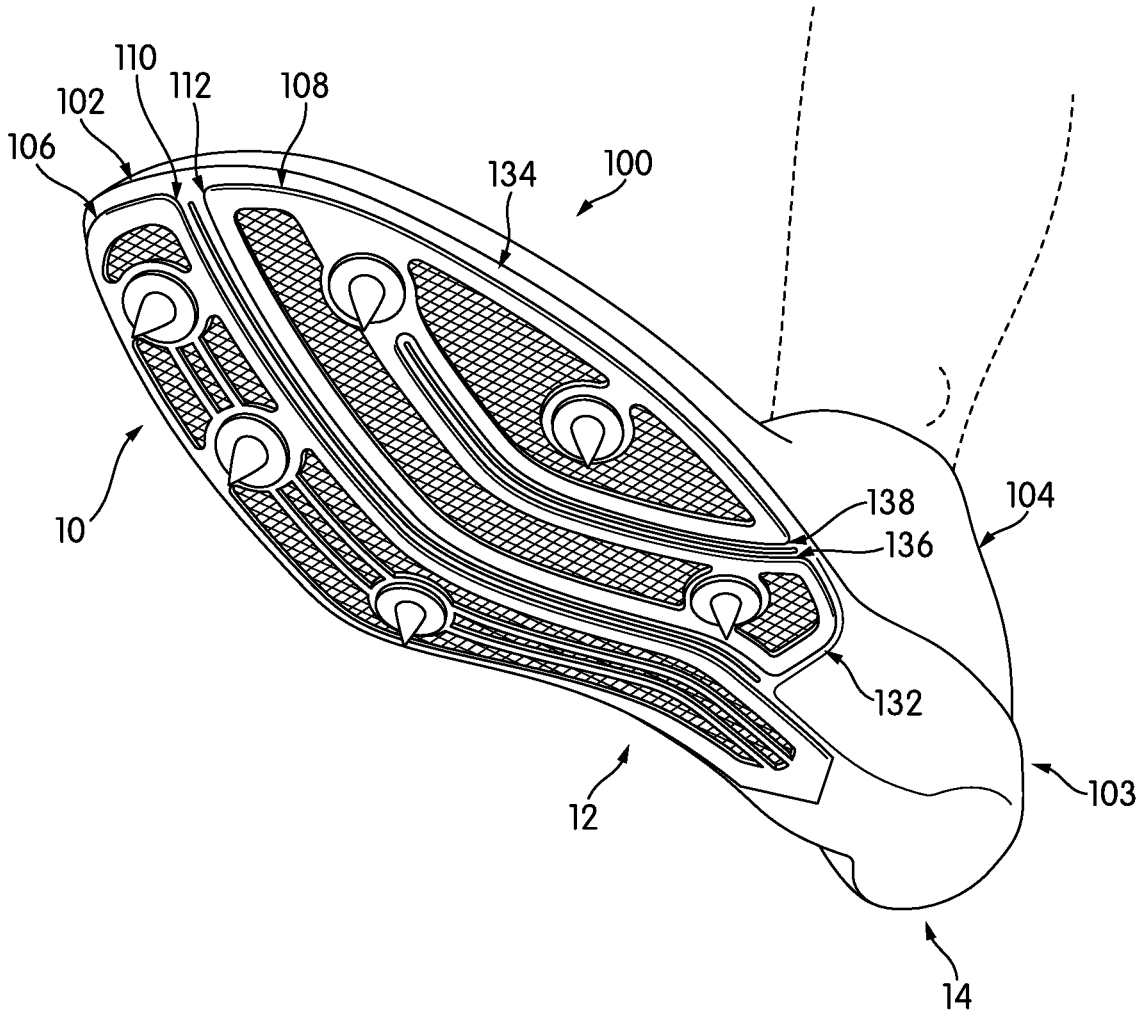
FIG. 12 is a bottom view of the sole plate of FIG. 1 after a second flexing of the sole plate.

As shown in FIGS. 11-12, the sole plate 102 returns to a rest shape and the user begins or continues to move the heel portion 14 downward towards the playing surface 701. As shown the rest shape is substantially planar. In other configurations, the rest shape may be concave or convex.

Figure 13:
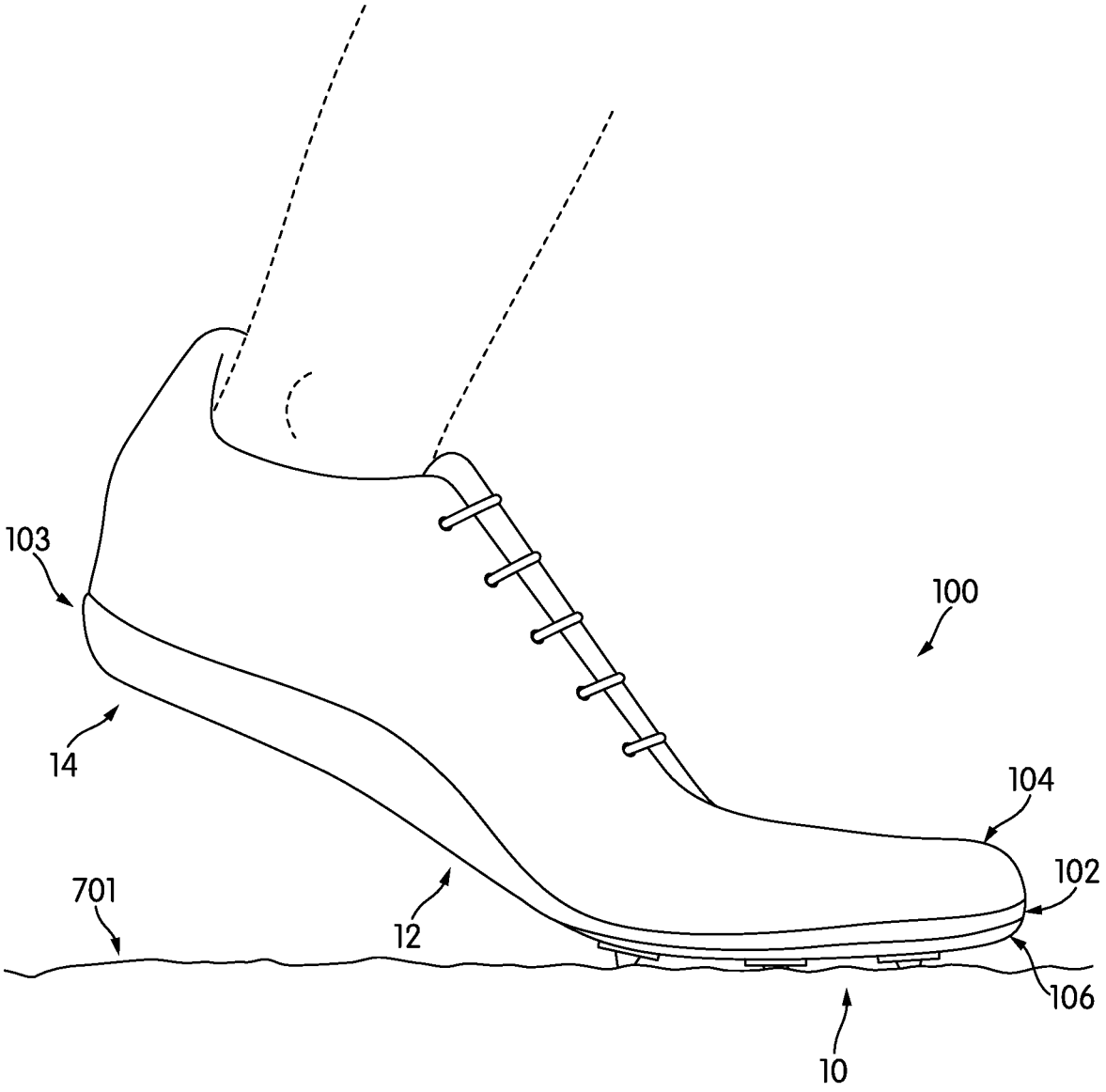
FIG. 13 is a side view of the sole plate of FIG. 1 after a flattening of the sole plate.
Figure 14:
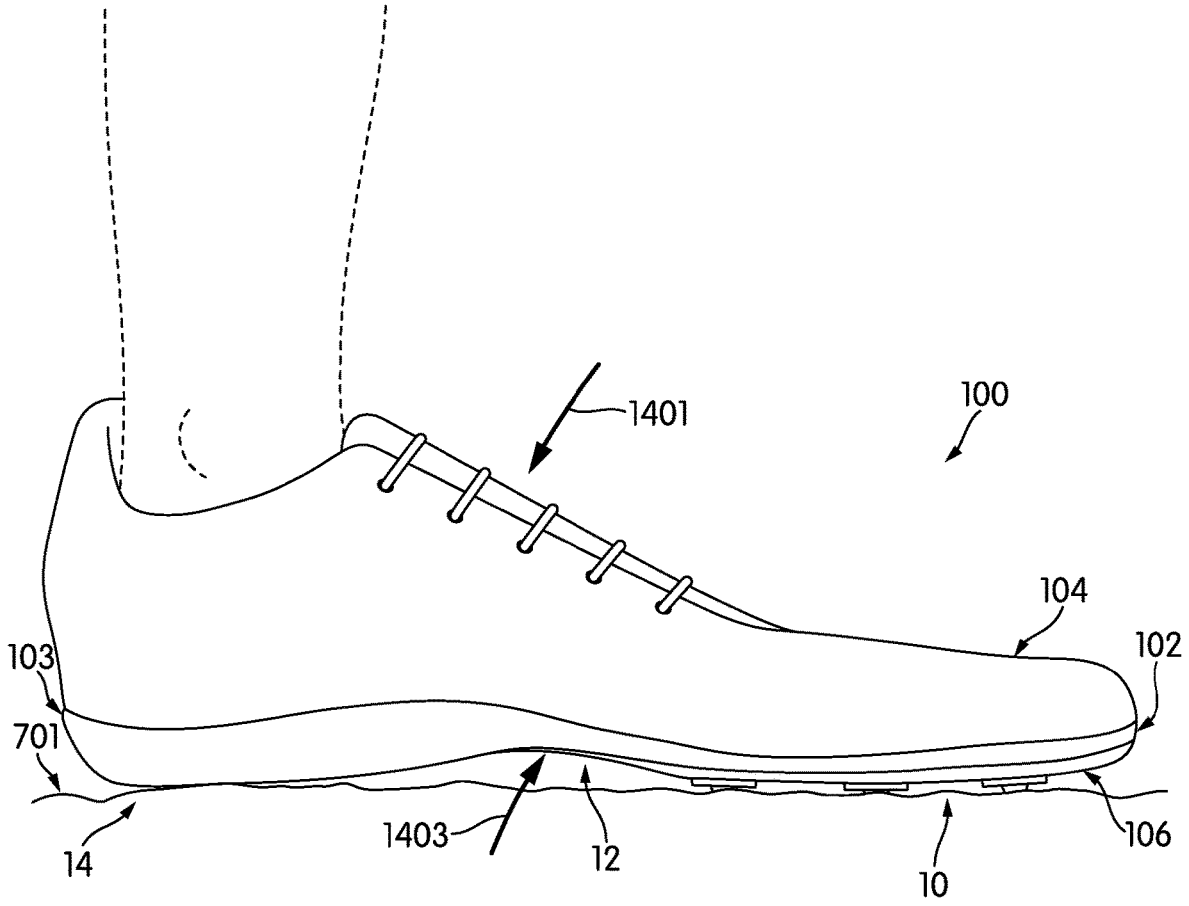
FIG. 14 is a side view of the sole plate of FIG. 1 after storing energy into the sole plate.
Figure 15:
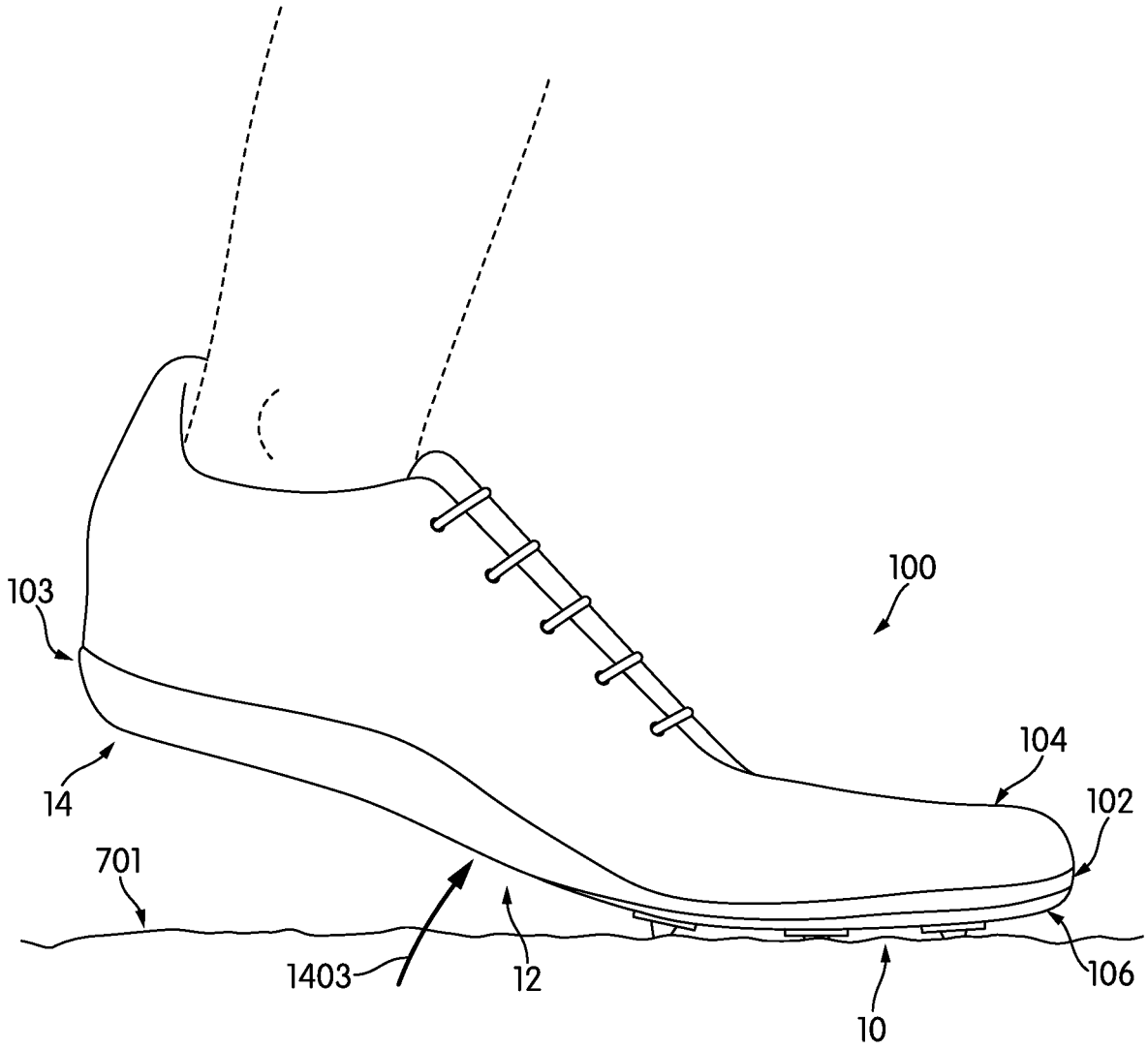
FIG. 15 is a side view of the sole plate of FIG. 1 during a releasing of the energy stored in the sole plate.
Figure 16:
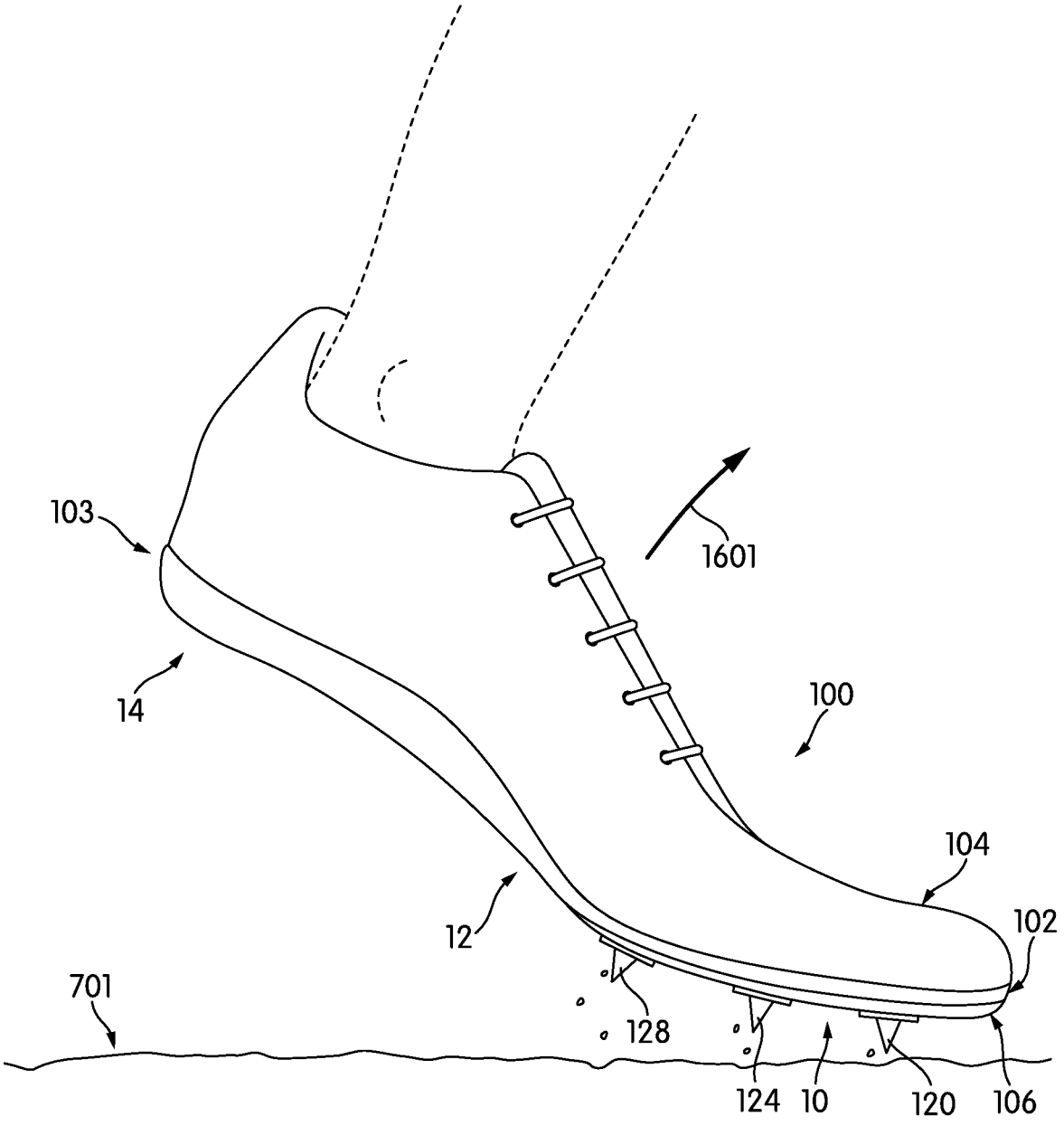
FIG. 16 is a side view of the sole plate of FIG. 1 after releasing energy stored in the sole plate.

As shown in FIGS. 13-14, the user forces the heel portion 14 downward into the playing surface 701. As shown in FIG. 14, downward movement 1401 of the heel portion 14 causes a bending of the sole plate 102. As such, the sole plate 102 may absorb a substantial amount of energy in resisting the bending action. Accordingly, as shown in FIG. 14 the sole plate 102 generates a return force 1403 to move the heel portion 14 upward from the playing surface 701. As shown in FIG. 15, the heel portion 14 is moved upward prior to the user lifting the article 100 away from playing surface 701. As shown in FIG. 16, once the sole plate 102 releases the return force 1403, the sole plate 102 returns to its original shape, and the user continues operation by lifting 1601 the article 100 from the playing surface 701.

Figure 17:
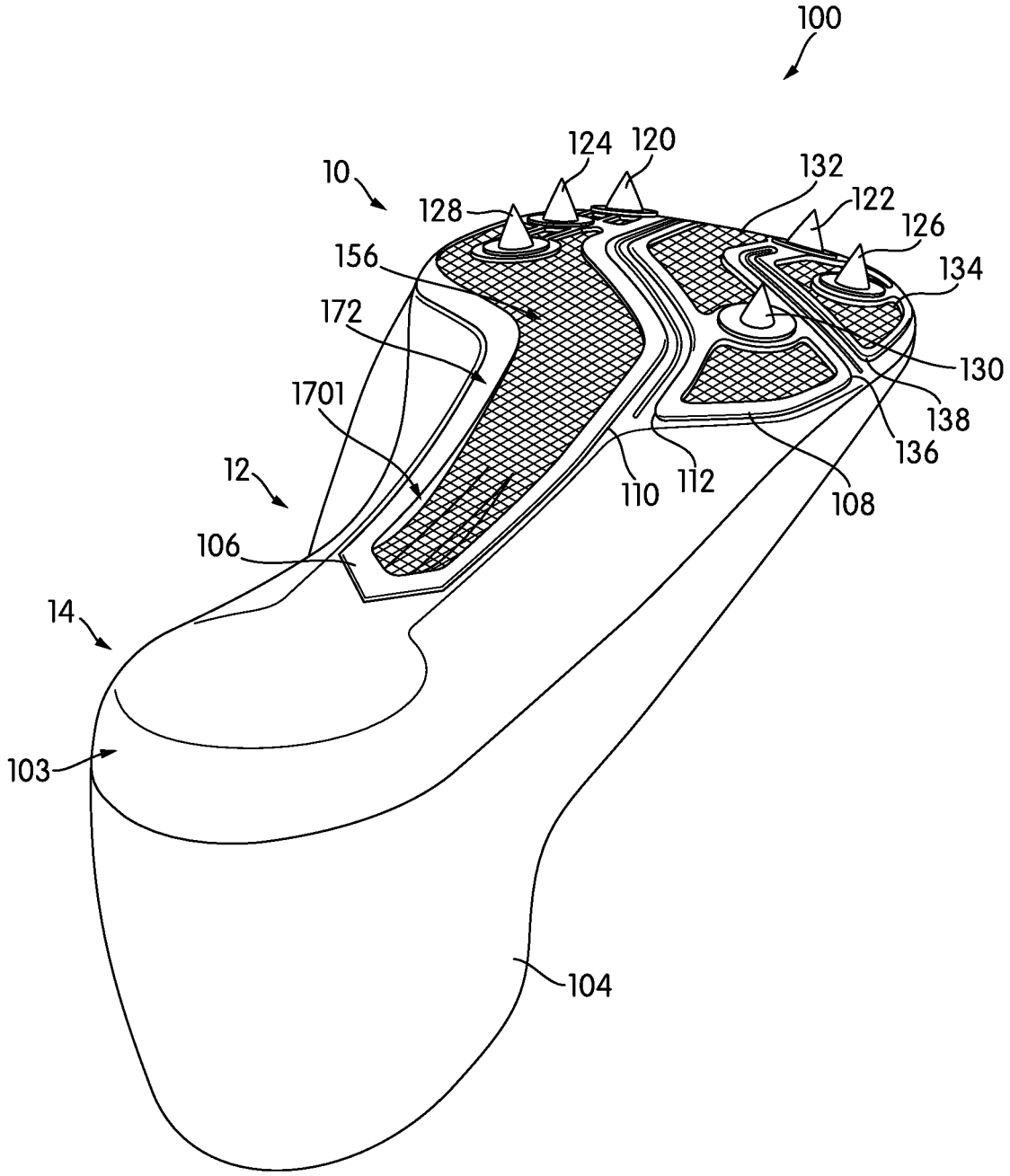
FIG. 17 is an isometric view of a second exemplary sole plate of the article of footwear of FIG. 1.

In some instances, further rigidity in the first plate 106 is desired to improve an amount of energy return during operation of the article 100. Accordingly, the first plate 106 may be formed to include a shape for increasing rigidity. For example, FIG. 17 illustrates a configuration of the article 100 that includes a concave portion 1701. As shown, concave portion 1701 extends into an exposed surface of the first plate 106. The shape of the concave portion 1701 may be substantially circular, rectangular, etc. In some configurations, the concave portion 1701 extends into the elastomer 172 but is separated from the first rigid member 156 by the elastomer 172. In one configuration, the elastomer 172 is locally thicker in this region of the first plate 106 to accommodate the concave portion 1701 and, as such, locally increases the rigidity of the first plate 106 in this region. As such, the concave portion 1701 may further increase the rigidity of the first plate 106 to improve an amount of energy return during operation of the article 100.

Figure 18:
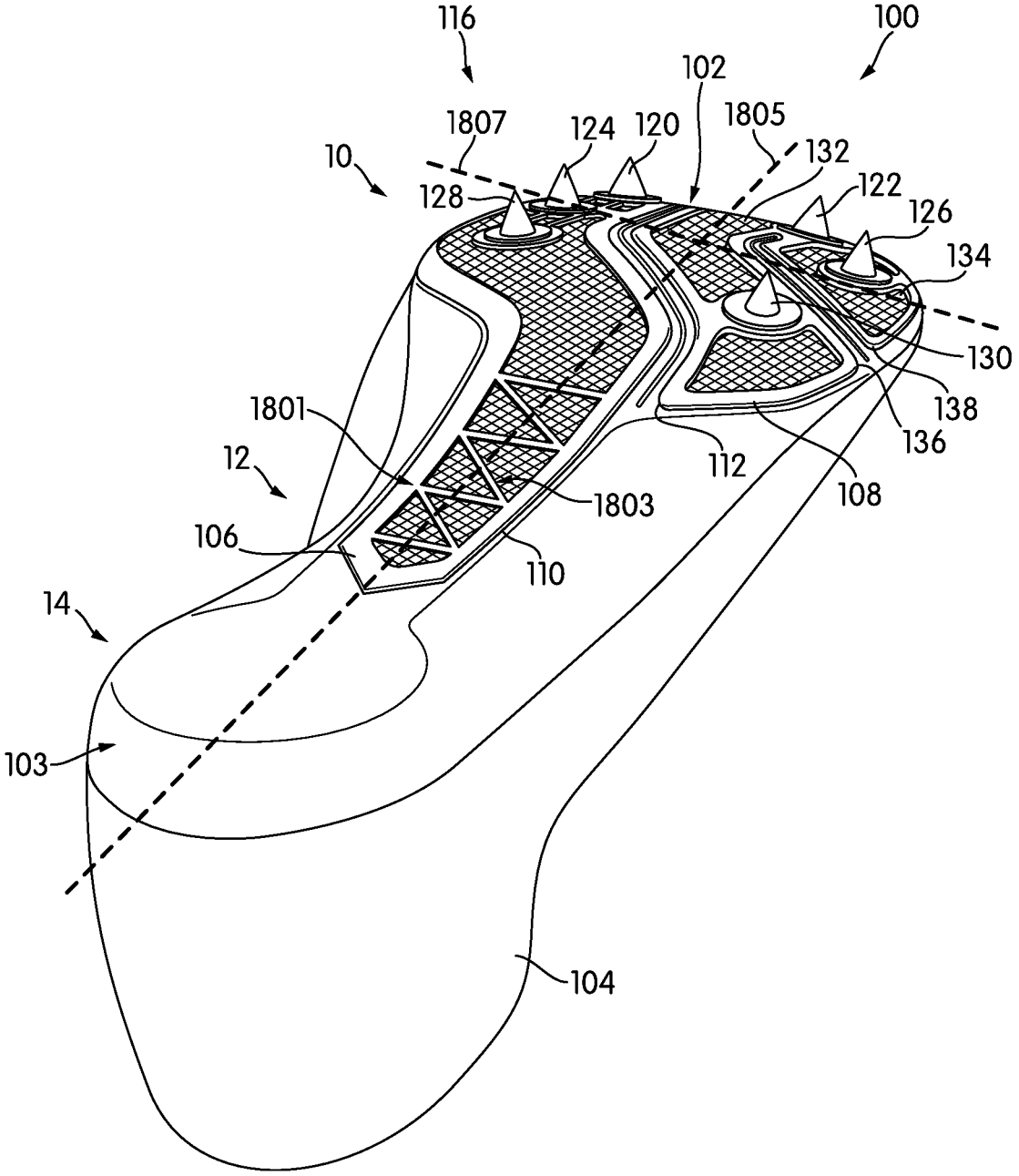
FIG. 18 is an isometric view of a third exemplary sole plate of the article of footwear of FIG. 1.

In some configurations, a cavity of the first plate 106 may include a portion having a shape to even further increase a rigidity of the first plate 106. For example, FIG. 18 illustrates a configuration of the article 100 that includes a crisscross portion 1801. As shown, crisscross portion 1801 extends into an exposed surface of the first plate 106. In one configuration, the crisscross portion 1801 is formed in concave portion 1701 (not shown). As shown, the crisscross portion 1801 is formed on the bottom surface 116 of sole plate 102. As such, the crisscross portion 1801 may even further increase rigidity in the sole plate 102 to improve an amount of energy return during operation of the article 100.

In one configuration, the crisscross portion 1801 includes lines oriented to further increase a rigidity of the sole plate 102. For instance, FIG. 18 illustrates lines 1803 of the crisscross portion 1801. The lines 1803 may extend along a longitudinal axis 1805, along a lateral axis 1807, or substantially between the longitudinal axis 1805 and the lateral axis 1807. For example, FIG. 18 illustrates the lines 1803 extending substantially between the longitudinal axis 1805 and the lateral axis 1807. As such, the lines 1803 may even further increase rigidity in the sole plate 102 to improve an amount of energy return during operation of the article 100.

In some applications it is desirable to have different flexibilities in different regions of an article. Such varying flexibilities may allow, for example, article 100 to be further customized to balance a user's comfort during operation and an energy return. For instance, a point of impact onto a playing surface may frequently occur in the forefoot portion 10 and rarely occur in the midfoot portion 12. Accordingly, the forefoot portion 10 may be configured to have a lower rigidity than the midfoot portion 12 to allow for improved user comfort during operation. Similarly, the midfoot portion 12 may be configured to have a higher rigidity than the forefoot portion 10 to allow for a higher energy return.

Figure 19:
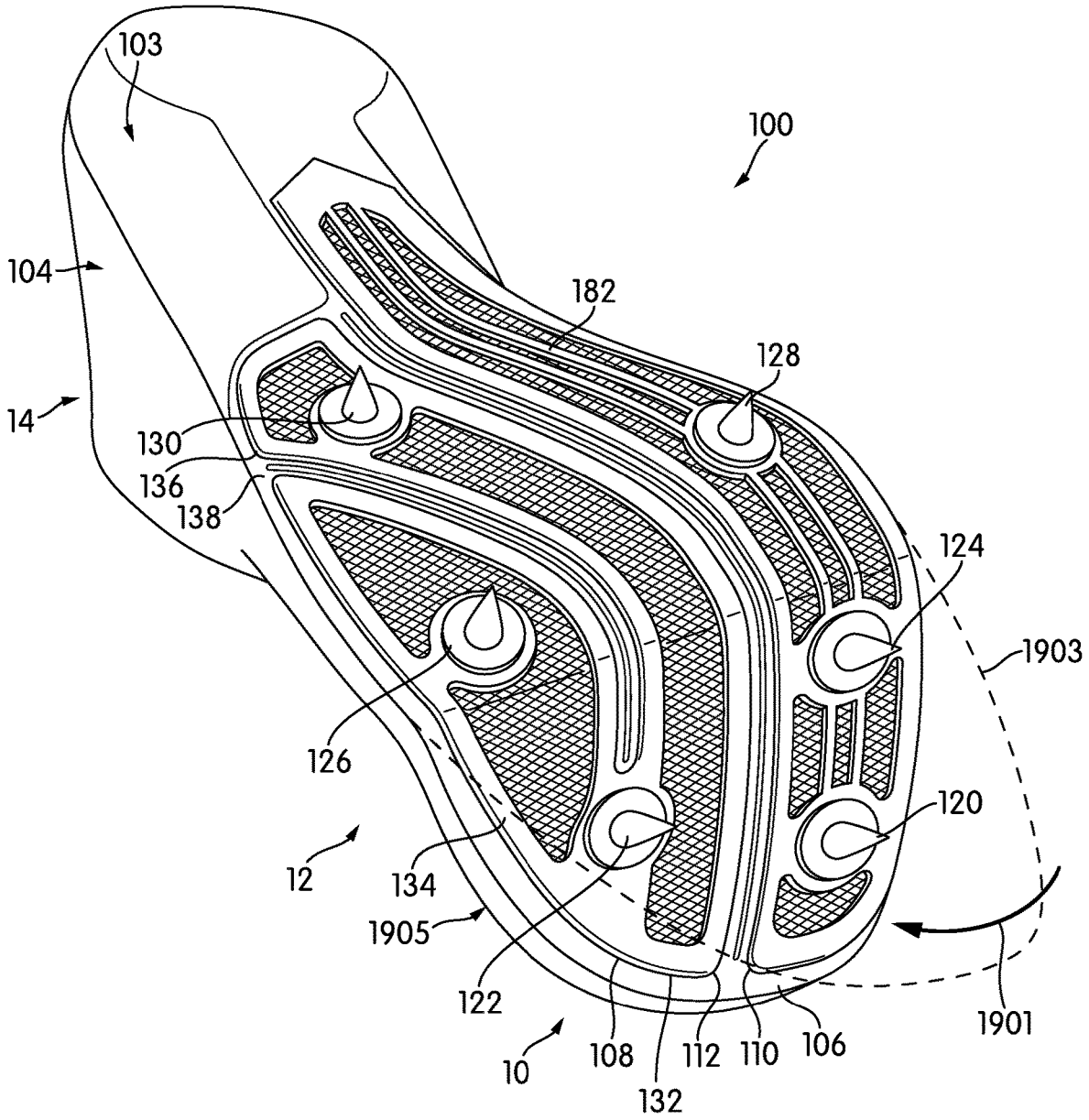
FIG. 19 is an isometric view of the sole plate of FIG. 1 during a force to flex a forefoot portion of the sole plate.
Figure 20:
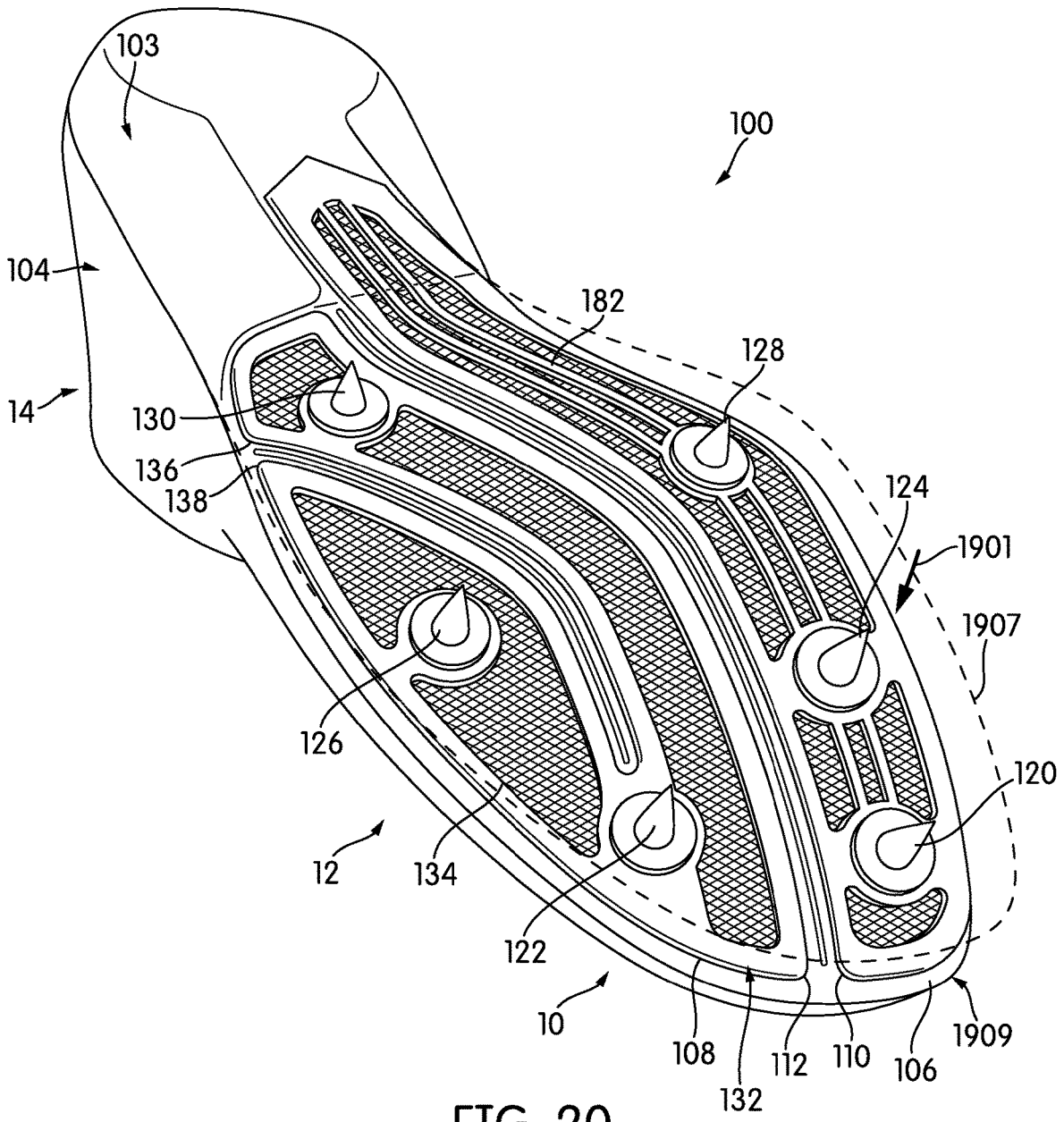
FIG. 20 is an isometric view of the sole plate of FIG. 1 during a force to flex a midfoot portion of the sole plate.

FIGS. 19 and 20 illustrate an exemplary degree of flex in a forefoot portion 10 of the article 100 and a midfoot portion 12 of the article 100. As shown in FIG. 19, a force 1901 applied towards a forward end of forefoot portion 10 may cause the article 100 to bend from a rest forefoot position 1903 to a forced forefoot position 1905. As shown in FIG. 20, in some configurations, the force 1901 applied further back in forefoot portion 10 (compared to the location of force 1901 in FIG. 19) may cause the article 100 to bend from a rest midfoot position 1907 to a forced midfoot position 1909. As shown, the force 1901 causes the forefoot portion 10 to bend more than the midfoot portion 12. Accordingly, in some configurations, the article 100 may allow the user to have an improved feel of the playing surface (e.g., 701) during an impact of the forefoot portion 10 while maximizing an energy return in the midfoot portion 12.

FIGS. 21-26 illustrate a configuration including a heel region. For example, in some instances, a user initially contacts a heel portion on a playing surface. Accordingly, a user may benefit from having an article of footwear configured for an initial contact on the heel portion.

Figure 21:
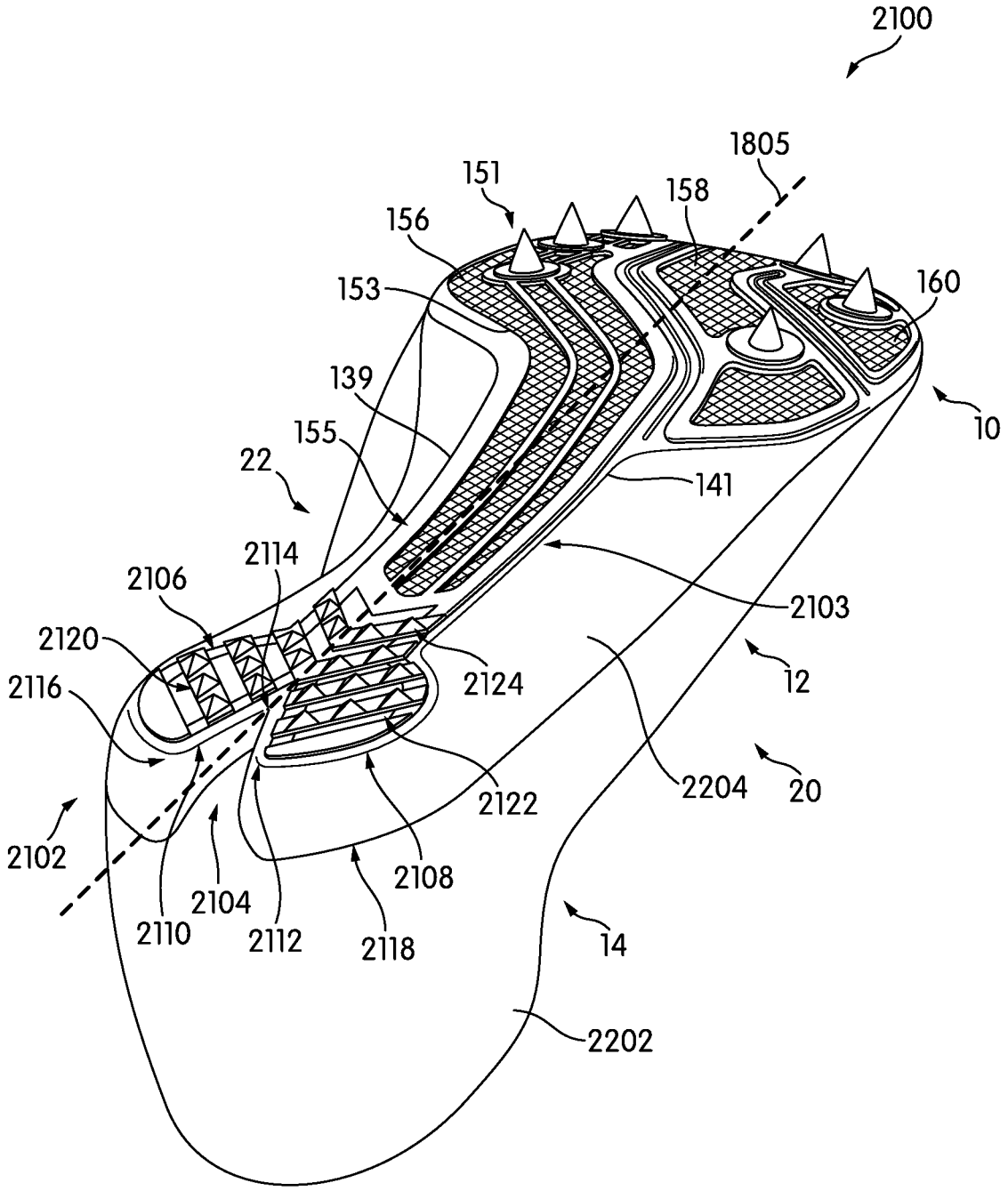
FIG. 21 is an isometric view of an exemplary configuration of an article of footwear including a sole plate having a heel region.

FIG. 21 illustrates an isometric view of an article of footwear 2100, or simply article 2100. In one configuration, the article 2100 includes a sole plate 2103 similar to sole plate 102 except for the heel portion 14. For example, the sole plate 2103 may have a forefoot portion 10 similar to a forefoot portion 10 of sole plate 102. Similarly, the sole plate 2103 may have a midfoot portion 12 similar to a midfoot portion 12 of sole plate 102. In other configurations, the sole plate 2103 has a different forefoot portion 10 than sole plate 102 and/or the sole plate 2103 has a different midfoot portion 12 than sole plate 102.

In some configurations, the heel region 2102 is part of the sole plate 2103. For example, as shown in FIG. 21, the heel region 2102 extends to the midfoot region 155 of the sole plate 2103. In one configuration, the sole plate 2103 and the heel region 2102 are monolithic. In other configurations, the sole plate 2103 and the heel region 2102 are separated (not shown). In some configurations, the heel region 2102 is attached to the first rigid member 156. In other configurations, the heel region 2102 is separated from the first rigid member 156.

In some configurations, the heel region 2102 includes a first heel region 2106 and a second heel region 2108. For example, as shown in FIG. 21, the first heel region 2106 extends towards the medial side 22 and the second heel region 2108 extends towards the lateral side 20.

In one configuration, the notch region 2104 separates the first heel region 2106 and the second heel region 2108. For example, as shown in FIG. 21, a medial edge 2110 of the notch region 2104 faces the second heel region 2108 and a lateral edge 2112 of the notch region 2104 faces the first heel region 2106. Further, the notch region 2104 includes a decreasing width in a direction extending from the heel portion 14 towards the midfoot portion 12. Namely, the edges 2110, 2112 may be disposed closer to one another in a direction extending from the heel portion 14 to the midfoot portion 12. In one configuration, the width of the notch region 2104 constantly tapers down in a direction extending from the heel portion 14 to the midfoot portion 12.

In some configurations, the notch region 2104 extends from an outer edge of the heel portion 14 toward the midfoot portion 12. For example, as shown in FIG. 21, the notch region 2104 extends from an exposed medial edge 139 to a notch tip 2114. In one configuration, the notch tip 2114 is positioned on the longitudinal axis 1805. For example, as shown in FIG. 21, the midfoot region 155 and the notch tip 2114 are positioned on the longitudinal axis 1805.

In one configuration, the notch region 2104 has a notch base 2116 extending along an exposed heel edge 2118. For example, as show in FIG. 21, the notch base 2116 extends from the medial edge 2110 to the lateral edge 2112. In some configurations, the medial edge 2110 and lateral edge 2112 form a portion of the exposed heel edge 2118. For example, as shown in FIG. 21, the exposed heel edge 2118 extends from the medial edge 2110 to the notch tip 2114 and the exposed heel edge 2118 extends from the lateral edge 2112 to the notch tip 2114.

In one configuration, the heel region 2102 extends from outer edges of the heel region 14. For example, as shown in FIG. 21, the first heel region 2106 extends from an exposed medial edge 139 of the heel portion 14 to the medial edge 2110 of the notch region 2104. Similarly, as shown in FIG. 21, the second heel region 2108 extends from an exposed lateral edge 141 of the heel portion 14 to the lateral edge 2112 of the notch region 2104.

It may be beneficial to shape the heel region 2102 to further allow flexing in the lateral direction. For instance, as discussed further in FIGS. 23-26, to improve a performance of the article 2100 during a heel impact. As shown in FIG. 21, the first heel region 2106 may include a first segment 2120 extending from the medial edge 2110 to the exposed medial edge 139 and the second heel region 2108 may include a second segment 2122 extending from the lateral edge 2112 to the exposed lateral edge 141.

Figure 23:
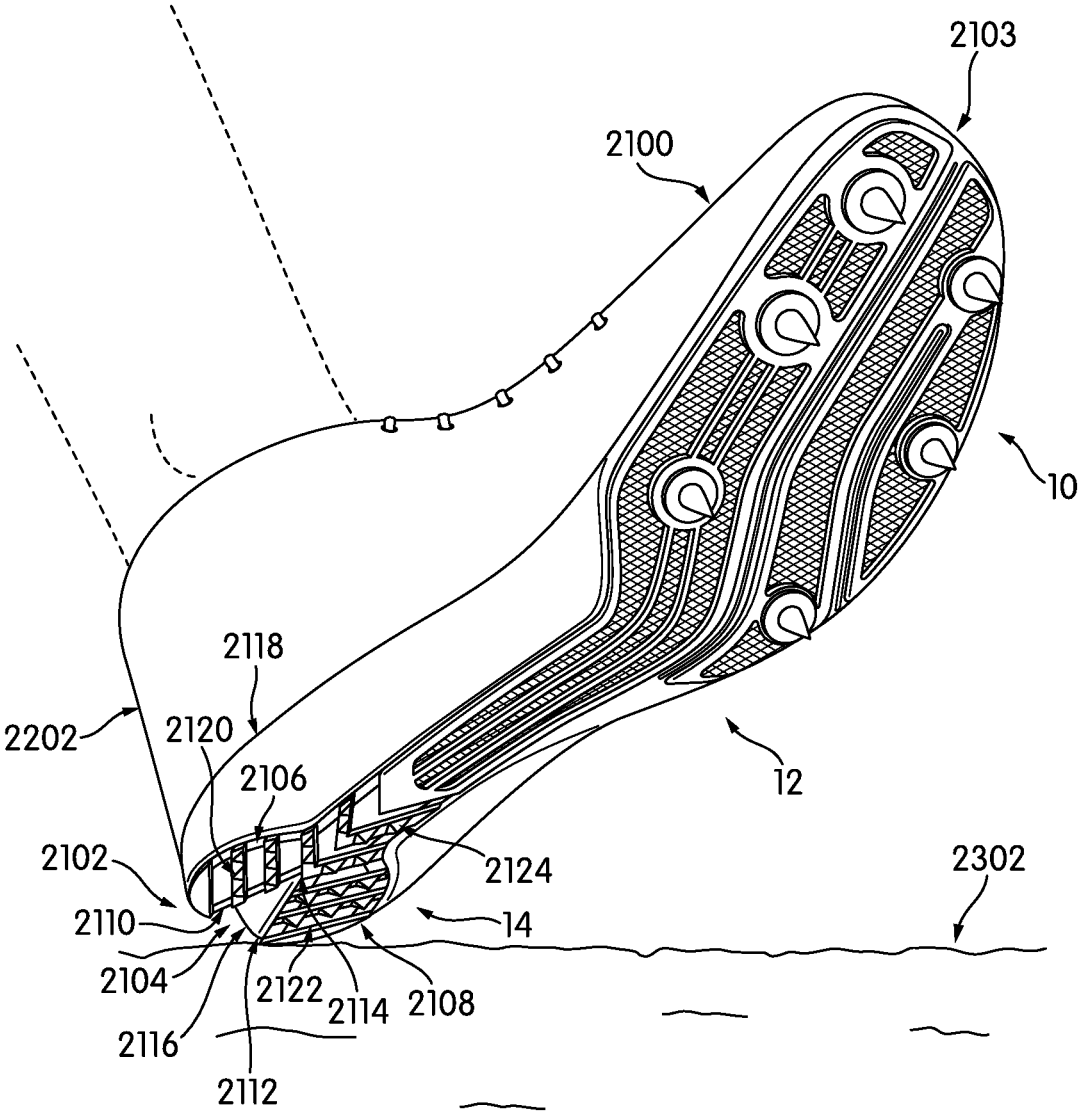
FIG. 23 is an isometric view of a heel region of the sole plate of FIG. 21 before contacting a surface.

In some instances, traction elements may be included in the heel region 2102. In an exemplary configuration, first segment 2120 and/or second segment 2122 may include a protrusion 2124 having a pyramid shape, as illustrated in FIG. 21. In other configurations, protrusion 2124 may include different shapes including but not limited to hexagonal, cylindrical, conical, circular, square, rectangular, trapezoidal, diamond, ovoid, as well as other regular or irregular and geometric or non-geometric shapes. Such protrusions act as traction elements that allow improved performance of the article 2100 by allowing a better grip onto playing surface 2302 (FIG. 23).

In one configuration, the heel region 2102 is formed of elastomer 172. For example, the sole plate 2103, second plate 108, and heel region 2102 may be formed of elastomer 172. In other configurations, the heel region 2102 is formed of a different material than the sole plate 2103 and/or second plate 108. For example, the sole plate 2103 and/or second plate 108 are formed of elastomer 172 and the heel region 2102 is formed of thermoplastic rubber, a thermoplastic elastomer (TPE) such as polyether block amide (PEBAX), and the like.

Figure 22:
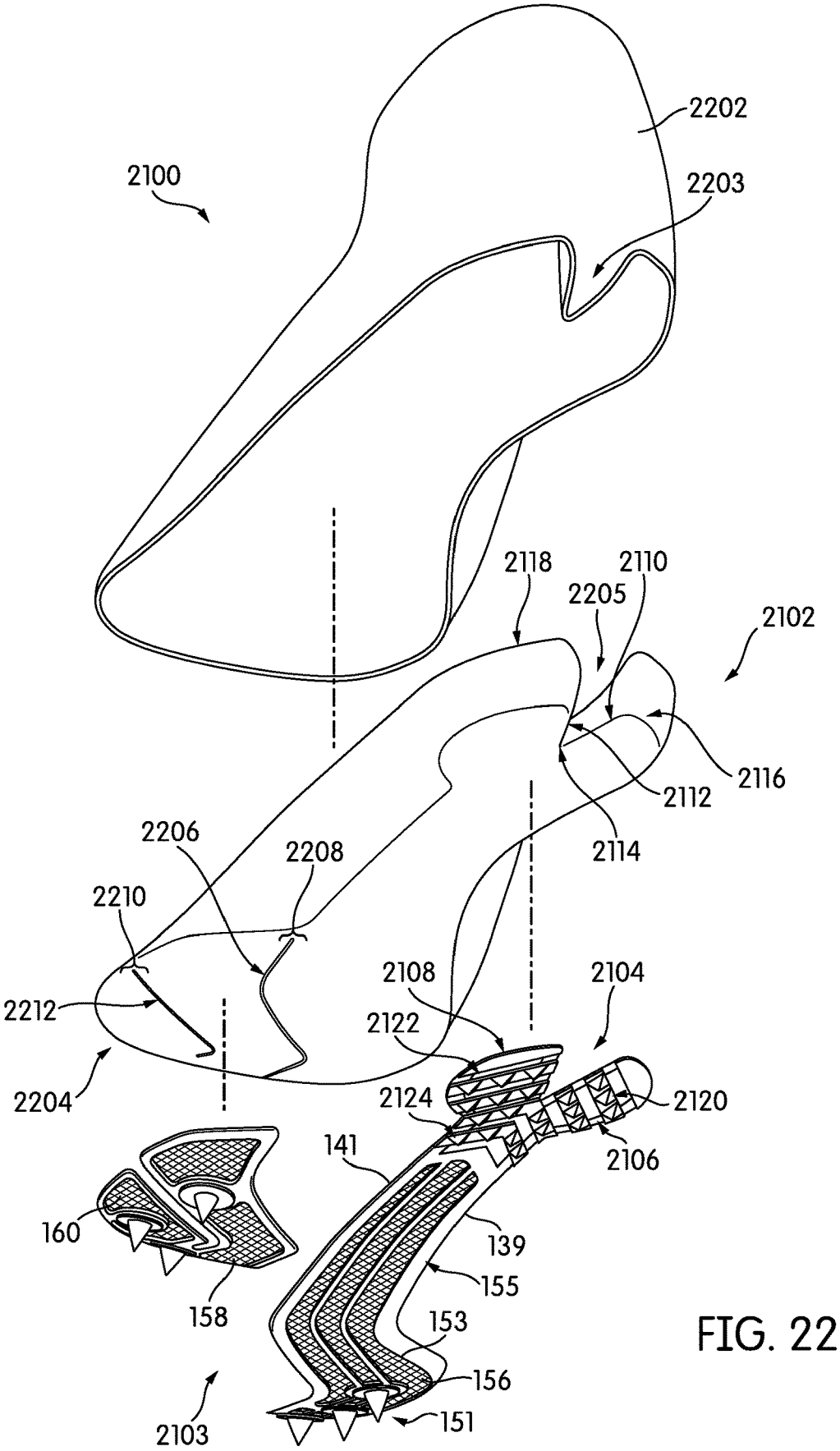
FIG. 22 is an exploded view of the sole plate of FIG. 21.

In one configuration, the article 2100 includes an upper 2202. The upper 2202 may be similar to the upper 104. For example, as shown in FIG. 22, the upper 2202 may be attached to the sole plate 2103 similar to the attaching of upper 104 to the sole plate 102. In another example, the upper 2202 and the upper 104 are formed of similar materials.

In some configurations, the upper 2202 is attached differently than the upper 104. For example, the upper 2202 may be attached to the sole plate 2103 by any known mechanism or method. Additionally, or alternatively, the upper 2202 may be stitched to sole plate 2103 and/or upper 2202 may be glued to sole plate 2103. In one configuration, the upper 2202 may be configured to receive a foot. The exemplary configuration shows a generic design for the upper. In some configurations, the upper may include another type of design. In some configurations, the upper 2202 and the upper 104 are formed of different materials.

In various configurations, the upper 2202 is formed differently from the upper 104. For example, as shown in FIG. 22, the upper 2202 includes an upper notch 2203. In some configurations, the upper notch 2203 may be aligned with the notch region 2104. In one configuration, the upper notch 2203 may be aligned with a midsole notch. For example, as shown in FIG. 22, the upper notch 2203 may be aligned with the midsole notch 2205. In other configurations, the upper notch 2203 may not correspond to the notch region 2104 and/or the midsole notch 2205. For example, the upper 2202 may be planar in a region corresponding to the notch region 2104 (not shown).

As shown in FIGS. 21 and 22, in some configurations, the article 2100 includes a midsole 2204. In some configurations, the midsole 2204 may be similar to midsole 103 of article 100. For example, as shown in FIG. 22, the midsole 2204 may include a first exposed portion 2208 corresponding to the portion 188 (see FIG. 5) and may include a first groove 2206 corresponding to the first groove 186 (see FIG. 5). In some configurations, as shown in FIG. 22, the midsole 2204 may include a second exposed portion 2210 corresponding to the portion 190 (see FIG. 5) and may include a second groove 2212 corresponding to the second groove 192 (see FIG. 5). In other configurations, the midsole 2204 is different from the midsole 103.

In some instances, it may be desirable to show a portion of the upper. For example, the upper 2202 may be formed of a seamless warp knit tube of mesh. Accordingly, in some configurations, the midsole 2204 includes a midsole notch 2205 that extends into the midsole. For example, as shown in FIG. 21, the medial edge 2110 extends through the midsole 2204 to upper 2202 and the lateral edge 2112 extends through the midsole 2204 to upper 2202. As such, a bottom surface of the upper 2202 may be visible, thereby improving an aesthetic appearance of the article 2100. In other configurations, the midsole 2204 may not correspond to the notch region 2104 and/or the upper notch 2203. For example, the midsole 2204 may be planar in a region corresponding to the notch region 2104 (not shown) and/or the midsole 2204 may be planar in a region corresponding to the upper notch 2103 (not shown).

FIGS. 23-26 illustrate an article of footwear during a heel strike operation. For example, as shown in FIGS. 23-26, the article of footwear is the article 2100. As shown in FIG. 23, a user contacts the heel region 2102 with a playing surface 2302.

Figure 24:
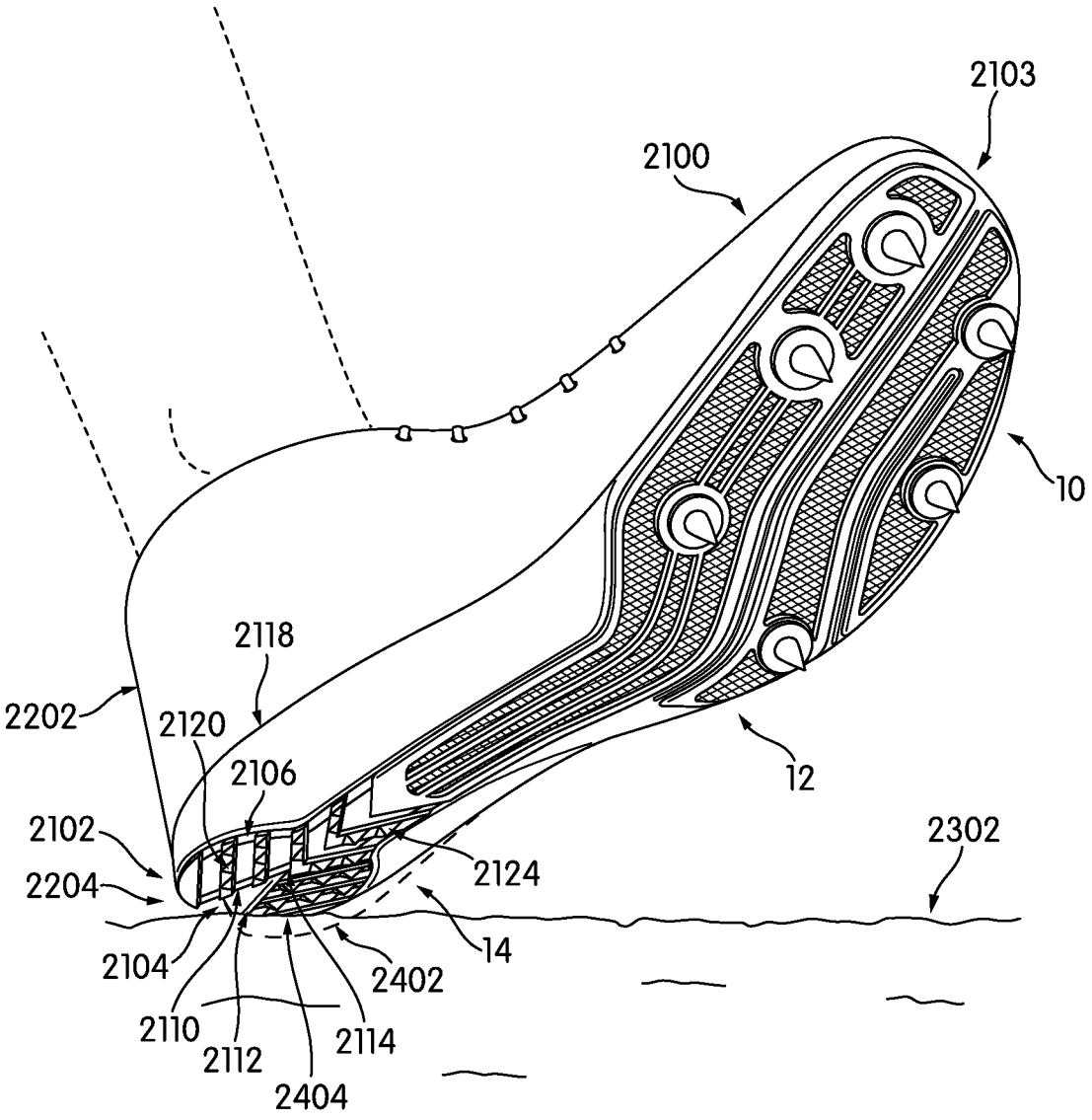
FIG. 24 is an isometric view of a heel region of the sole plate of FIG. 21 during a flexing of the heel region.

As shown in FIG. 24, the impact causes the heel region 2102 to flex in the notch region 2104. The flex bends the heel region 2102 from a rest position 2402 to a flex position 2404.

This flexing allows a more natural feel to a user, as the article allows the user to feel a shape of the playing surface 2302. In some configurations, the heel region 2102 is substantially planar prior to the impact. In other configurations, the heel region 2102 has a rest position that has a curved surface.

Figure 25:
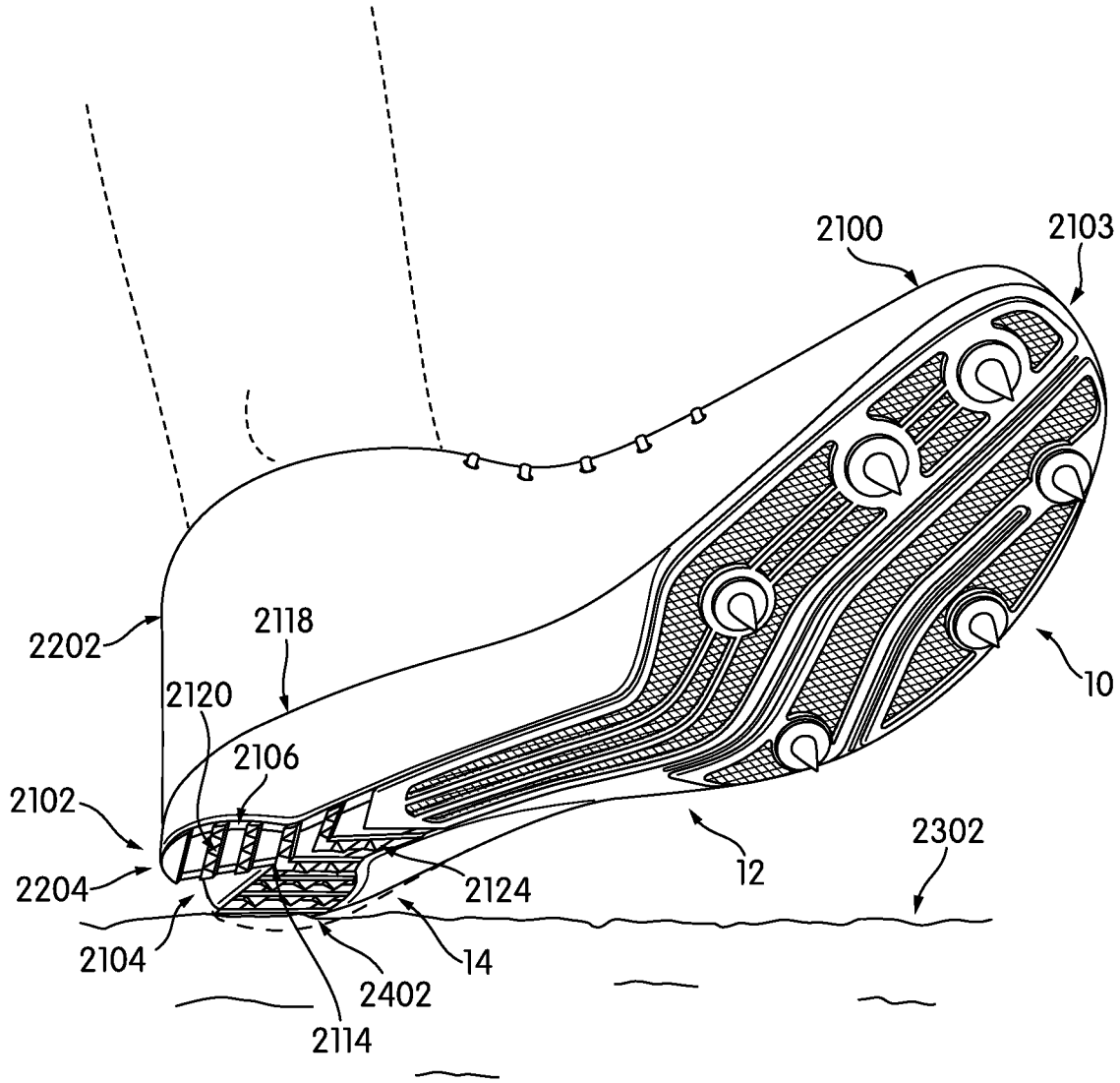
FIG. 25 is an isometric view of a heel region of the sole plate of FIG. 21 after a flexing of the heel region.

As shown in FIG. 25, the heel region 2102 begins to return to the rest position 2402 and the user begins or continues to move the forefoot portion 10 downward towards the playing surface 2302.

Figure 26:
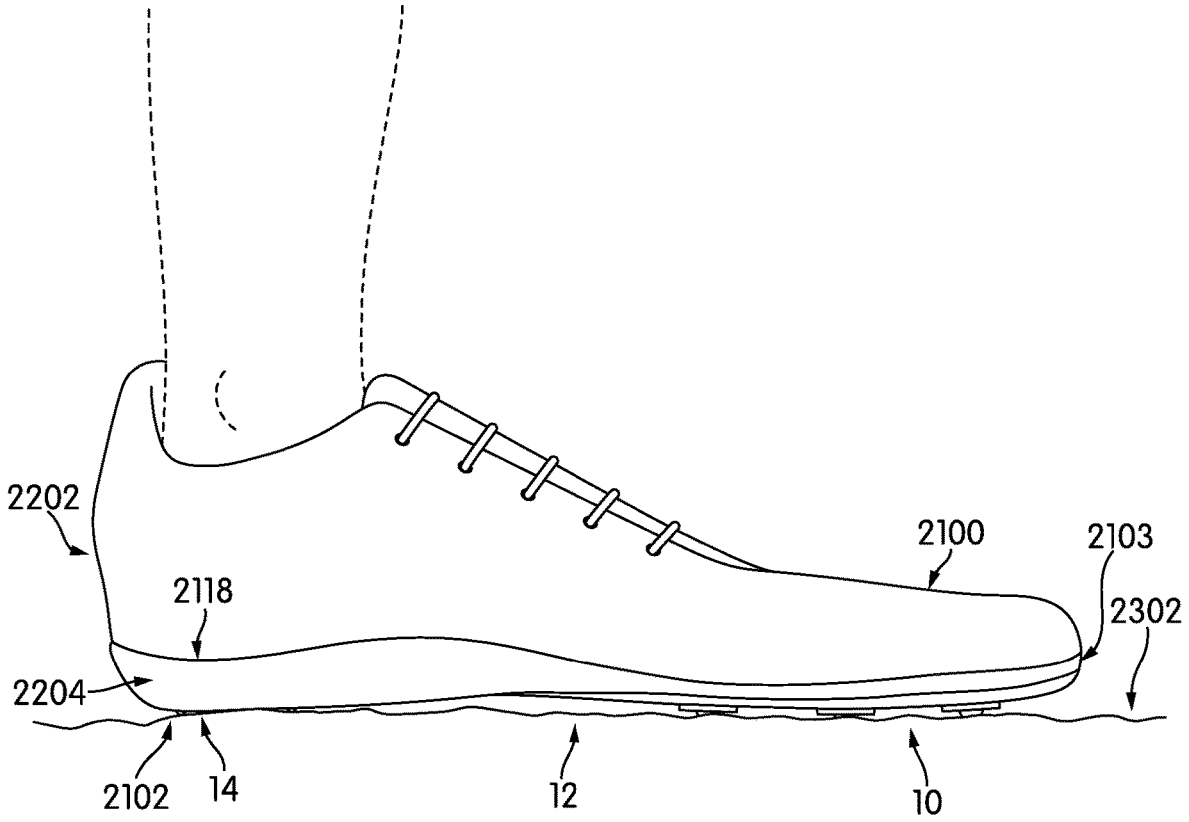
FIG. 26 is a side view of a heel region of the sole plate of FIG. 21 after a flattening of the heel region.

FIG. 26 illustrates the heel region 2102 returned to the rest position 2402, and the user continues operation by shifting the forefoot portion 10 to contact the playing surface 2302.

The following Clauses provide an exemplary configuration for the article of footwear 100 and a method of manufacturing the article of footwear 100 described above.

Clause 1: An article of footwear may include a sole comprising a first plate and a second plate, wherein the first plate is spaced from the second plate. The first plate may extend along a longitudinal axis from a midfoot portion of the article of footwear to a heel portion of the article of footwear. The second plate may extend from a forefoot portion of the article of footwear to the midfoot portion of the article of footwear. The first plate may include a first edge and the second plate may include a second edge, whereby the first edge faces the second edge. The first edge may have a first contour corresponding to a second contour of the second edge. The first plate may include a heel region, whereby the heel region includes a first heel region and a second heel region. Finally, a notch region may separate the first heel region and the second heel region, whereby the notch region extends from an outer edge of the heel region toward the midfoot portion of the article of footwear.

Clause 2: The article of footwear according to Clause 1, wherein the first plate includes a forefoot region, a transition region, and a midfoot region; the transition region extending between the forefoot region and the midfoot region; and wherein the midfoot region extends from an exposed lateral edge of the sole to an exposed medial edge of the sole.

Clause 3: The article of footwear according to Clauses 1 or 2, wherein the longitudinal axis is centrally located between the medial side and the lateral side.

Clause 4: The article of footwear according to any one of Clauses 1-3, wherein the first plate includes a first rigid member, the first rigid member extending from the forefoot portion to the heel portion; and wherein the second plate includes a second rigid member, the second rigid member extending from the forefoot portion to the midfoot portion.

Clause 5: The article of footwear according to Clause 4, wherein the first rigid member extends along the first contour, the first rigid member maintaining a substantially constant first distance from the first edge; and wherein the second rigid member extends along the second contour, the second rigid member maintaining a substantially constant second distance from the second edge.

Clause 6: The article of footwear according to Clause 5, wherein the second plate includes a central region and a lateral region; wherein the central region includes the second edge and wherein the central region also includes a third edge; wherein the second edge is opposite to the third edge; wherein the third edge has a third contour corresponding to the first contour of the first edge; wherein the lateral region includes a fourth edge, the fourth edge facing the third edge; and wherein the fourth edge has a fourth contour corresponding to the second contour of the second edge.

Clause 7: The article of footwear according to Clause 6, wherein the second plate includes a third rigid member, the third rigid member extending from the forefoot portion to the midfoot portion; wherein the third rigid member extends along the fourth contour, the third rigid member maintaining a substantially constant third distance from the fourth edge; and wherein the second rigid member extends along the third contour, the second rigid member maintaining a substantially constant fourth distance from the third edge.

Clause 8: The article of footwear according to Clause 7, wherein the first plate includes a first set of cleats, the first set of cleats being disposed under the first rigid member; and wherein the second plate includes a second set of cleats, the second set of cleats being disposed under the second rigid member and the third rigid member.

Clause 9: The article of footwear according to Clause 8, wherein the first rigid member is attached to the first set of cleats by an elastomer; and wherein the second rigid member and the third rigid member are attached to the second set of cleats by the elastomer.

Clause 10: The article of footwear according to Clause 9, wherein the heel region is formed of the elastomer; and wherein the heel region is attached to the first rigid member.

Clause 11: The article of footwear according to Clauses 9 or 10, wherein the first plate includes a rib, the rib extending from an outer surface of the first rigid member; and wherein the rib is formed of the elastomer.

Clause 12: The article of footwear according to Clause 11, wherein the rib has a contour corresponding to a shape of the first plate.

Clause 13: The article of footwear according to any one of Clauses 1-12, further comprising: a midsole comprising an upper surface and a lower surface, the lower surface of the midsole being attached to the sole; an upper attached to the upper surface of the midsole; and wherein the lower surface of the midsole is exposed between the first edge and the second edge.

Clause 14: The article of footwear according to any one of Clauses 1-13, wherein the first rigid member is carbon fiber.

Clause 15: The article of footwear according to any one of Clauses 1-14, wherein the first plate and the second plate are attached to an upper of the article of footwear.

Clause 16: A method of manufacturing an article footwear comprising: providing a sole comprising a first plate and a second plate, wherein the first plate is spaced from the second plate, the first plate extends from a forefoot portion of the article of footwear to a heel portion of the article of footwear, the second plate extends from the forefoot portion of the article of footwear to a midfoot portion of the article of footwear, the first plate includes a first edge and the second plate includes a second edge, the first edge faces the second edge, the first edge has a first contour corresponding to a second contour of the second edge, the first plate includes a heel region, the heel region includes a first heel region and a second heel region, a notch region separates the first heel region and the second heel region, and the notch region extends from an outer edge of the heel region toward the midfoot portion of the article of footwear; and combining the sole with an upper to form an article of footwear.

The foregoing description has been provided for purposes of illustration and description. It is not intended to be exhaustive or to limit the disclosure. Individual elements or features of a particular configuration are generally not limited to that particular configuration, but, where applicable, are interchangeable and can be used in a selected configuration, even if not specifically shown or described. The same may also be varied in many ways. Such variations are not to be regarded as a departure from the disclosure, and all such modifications are intended to be included within the scope of the disclosure.

What is claimed is:

1. An article of footwear comprising:

an upper;

a midsole attached to the upper and including a first surface opposing the upper and a second surface formed on an opposite side of the midsole than the first surface;

a unitary first sole plate attached to the midsole and including a first rigidity higher than a rigidity of the midsole and a first edge having a forefoot segment extending in a lengthwise direction of the first sole plate along a first axis and a midfoot segment extending in the lengthwise direction of the first sole plate along a second axis offset from the first axis; and a unitary second sole plate attached to the midsole and including a second rigidity higher than the rigidity of the midsole and a second edge extending along a length of the second sole plate, the second edge opposing and spaced apart from the first edge; and a channel extending between the first edge and the second edge and having a constant width along the entire length of the first edge and the second edge, the channel having a longitudinal axis that extends along a direction from a forefoot region of the midsole to a heel region of the midsole.

2. The article of footwear of claim 1, wherein the midsole includes a groove formed into the midsole in an area between the first sole plate and the second sole plate.

3. The article of footwear of claim 2, wherein the groove is formed along the channel.

4. The article of footwear of claim 2, wherein the groove includes the same shape as and is positioned within the channel.

5. The article of footwear of claim 1, further comprising at least one first cleat attached to the first sole plate and at least one second cleat attached to the second sole plate.

6. The article of footwear of claim 1, wherein the first sole plate includes a first rigid member and the second sole plate includes a second rigid member, the first rigid member and the second rigid member being attached to the midsole via an elastomer.

7. The article of footwear of claim 6, further comprising at least one first cleat attached to the first sole plate and at least one second cleat attached to the second sole plate, the at least one first cleat extending from the elastomer and including a flange disposed between the first rigid member and the elastomer and the at least one second cleat extending from the elastomer and including a flange disposed between the second rigid member and the elastomer.

8. The article of footwear of claim 6, wherein the second sole plate includes a third rigid member at least partially spaced apart from the second rigid member.

9. The article of footwear of claim 8, further comprising a channel at least partially separating the second rigid member from the third rigid member.

10. The article of footwear of claim 6, wherein the elastomer extends over a portion of the first rigid member and extends over a portion of the second rigid member.

11. An article of footwear comprising: an upper; a midsole attached to the upper and including a first surface opposing the upper and a second surface formed on an opposite side of the midsole than the first surface; a unitary first sole plate attached to the midsole and including a first rigid member attached to the midsole by an elastomer, the first rigid member having a higher rigidity than the midsole and the elastomer, the elastomer extending over a peripheral edge of the first rigid member and contacting the midsole such that the first rigid member extends between and separates the midsole and the elastomer and is exposed at a first opening defined by the elastomer; a unitary second sole plate attached to the midsole and including a second rigid member attached to the midsole by the elastomer, the second rigid member having a higher rigidity than the midsole and the elastomer, the elastomer extending over a peripheral edge of the second rigid member and contacting the midsole such that the second rigid member extends between and separates the midsole and the elastomer and is exposed at a second opening defined by the elastomer; and further comprising at least one first cleat attached to the first sole plate and at least one second cleat attached to the second sole plate.

12. The article of footwear of claim 11, wherein the first sole plate is spaced apart from the second sole plate by a channel.

13. The article of footwear of claim 12, wherein the midsole includes a groove formed into the midsole in an area between the first sole plate and the second sole plate.

14. The article of footwear of claim 13, wherein the groove is formed along the channel.

15. The article of footwear of claim 13, wherein the groove includes the same shape as and is positioned within the channel.

16. The article of footwear of claim 11, wherein the at least one first cleat extends from the elastomer and includes a flange disposed between the first rigid member and the elastomer and the at least one second cleat extends from the elastomer and includes a flange disposed between the second rigid member and the elastomer.

17. The article of footwear of claim 11, wherein the second sole plate includes a third rigid member at least partially spaced apart from the second rigid member.

18. The article of footwear of claim 17, further comprising a channel at least partially separating the second rigid member from the third rigid member.

19. The article of footwear of claim 11, wherein the elastomer extends over a portion of the first rigid member and extends over a portion of the second rigid member.

* * * * *